US010808517B2

(12) United States Patent
Moss, Jr.

(10) Patent No.: US 10,808,517 B2
(45) Date of Patent: Oct. 20, 2020

(54) EARTH-BORING SYSTEMS AND METHODS FOR CONTROLLING EARTH-BORING SYSTEMS

(71) Applicant: Baker Hughes, a GE company, LLC, Houston, TX (US)

(72) Inventor: William A. Moss, Jr., Conroe, TX (US)

(73) Assignee: Baker Hughes Holdings LLC, Houston, TX (US)

( * ) Notice: Subject to any disclaimer, the term of this patent is extended or adjusted under 35 U.S.C. 154(b) by 110 days.

(21) Appl. No.: 16/222,442

(22) Filed: Dec. 17, 2018

(65) Prior Publication Data

US 2020/0190961 A1 Jun. 18, 2020

(51) Int. Cl.
*E21B 44/00* (2006.01)
*E21B 44/06* (2006.01)
(Continued)

(52) U.S. Cl.
CPC ..... *E21B 44/06* (2013.01); *E21B 3/02* (2013.01); *E21B 7/04* (2013.01); *E21B 19/008* (2013.01);
(Continued)

(58) Field of Classification Search
CPC ..... E21B 44/00; E21B 44/02; E21B 44/06
See application file for complete search history.

(56) References Cited

U.S. PATENT DOCUMENTS 4,798,988 A 1/1989 Mitsutsuka
4,815,342 A 3/1989 Brett et al.
(Continued)

FOREIGN PATENT DOCUMENTS

CA 2009654 2/1991
CN 1462866 A 12/2003
(Continued)

OTHER PUBLICATIONS

Pessier et al., Quantifying Common Drilling Problems with Mechanical Specific Energy and a Bit-Specific Coefficient of Sliding Friction, Society of Petroleum Engineers, SPE 24584, (1992), pp. 373-388.

(Continued)

*Primary Examiner* — Kristyn A Hall
(74) *Attorney, Agent, or Firm* — TraskBritt

(57) ABSTRACT

In some embodiments, systems for automatically and dynamically controlling a drill string for drilling an earth formation may include a length of drill pipe, an earth-boring tool, a drawworks, a rotational apparatus, and a pump. A control unit may store software that causes the control unit to: accept a planned trajectory; divide the planned trajectory into a predetermined number of sections, normalizing the distance; receive operational state data from the drawworks, the rotational apparatus, and the pump; at least periodically calculate a normalized performance metric at least in part by dividing a raw performance metric by a distance per section; compare the calculated normalized performance metric to a benchmark performance metric; and send a control signal to cause the drawworks, the rotational apparatus, the pump, or any combination of these to automatically change an operating parameter to better match a corresponding operating parameter that achieved the benchmark performance metric.

20 Claims, 7 Drawing Sheets

(51) Int. Cl.

| | |
|---|---|
| ***E21B 21/08*** | (2006.01) |
| ***E21B 44/04*** | (2006.01) |
| ***E21B 47/04*** | (2012.01) |
| ***E21B 7/04*** | (2006.01) |
| ***E21B 19/00*** | (2006.01) |
| ***E21B 3/02*** | (2006.01) |
| ***E21B 47/024*** | (2006.01) |

(52) U.S. Cl.

CPC ..... *E21B 21/08* (2013.01); *E21B 44/04* (2013.01); *E21B 47/024* (2013.01); *E21B 47/04* (2013.01)

(56) References Cited

U.S. PATENT DOCUMENTS 5,305,836 A 4/1994 Holbrook et al.
5,321,981 A 6/1994 Macpherson
5,548,563 A 8/1996 Slevinsky
5,605,198 A 2/1997 Tibbitts et al.
5,608,162 A 3/1997 Ho
5,653,300 A 8/1997 Lund et al.
5,679,894 A 10/1997 Kruger et al.
5,699,246 A 12/1997 Plasek et al.
5,883,583 A 3/1999 Kishino
5,905,657 A 5/1999 Celniker
6,012,016 A 1/2000 Bilden et al.
6,021,859 A 2/2000 Tibbitts et al.
6,095,262 A 8/2000 Chen
6,109,368 A 8/2000 Goldman et al.
6,233,524 B1 5/2001 Harrell et al.
6,276,465 B1 8/2001 Cooley et al.
6,347,292 B1 2/2002 Denny et al.
6,349,595 B1 2/2002 Civolani et al.
6,353,799 B1 3/2002 Meany et al.
6,408,953 B1 6/2002 Goldman et al.
6,424,919 B1 7/2002 Moran et al.
6,434,435 B1 8/2002 Tubel et al.
6,519,568 B1 2/2003 Harvey et al.
6,542,076 B1 4/2003 Joao
6,542,077 B2 4/2003 Joao
6,722,450 B2 4/2004 Schultz et al.
6,722,453 B1 4/2004 Crooks
6,732,052 B2 5/2004 Macdonald et al.
6,745,159 B1 6/2004 Todd et al.
6,785,641 B1 8/2004 Huang
6,801,197 B2 10/2004 Sanstrom
6,823,297 B2 11/2004 Jenny et al.
6,836,731 B1 12/2004 Whalley et al.
6,840,317 B2 1/2005 Hirsch et al.
6,879,947 B1 4/2005 Glass
6,892,812 B2 5/2005 Niedermayr et al.
6,901,391 B2 5/2005 Storm et al.
6,907,375 B2 6/2005 Guggari et al.
6,944,547 B2 9/2005 Womer et al.
6,980,929 B2 12/2005 Aronstam et al.
6,980,940 B1 12/2005 Gurpinar et al.
7,003,439 B2 2/2006 Aldred et al.
7,020,597 B2 3/2006 Oliver et al.
7,027,968 B2 4/2006 Choe et al.
7,032,689 B2 4/2006 Goldman et al.
7,035,778 B2 4/2006 Goldman et al.
7,207,396 B2 4/2007 Hall et al.
7,258,175 B2 8/2007 Veeningen et al.
7,261,167 B2 8/2007 Goldman et al.
7,286,959 B2 10/2007 Steinke
7,357,196 B2 4/2008 Goldman et al.
7,596,481 B2 9/2009 Zamora et al.
7,653,563 B2 1/2010 Veeningen et al.
7,693,695 B2 4/2010 Huang et al.
7,757,781 B2 7/2010 Hay et al.
7,810,584 B2 10/2010 Haci et al.
7,899,658 B2 3/2011 Oliver et al.
7,921,937 B2 4/2011 Brackin et al.
8,145,462 B2 3/2012 Foucault
8,204,697 B2 6/2012 Garvey et al.
8,214,188 B2 7/2012 Bailey et al.
8,296,114 B2 10/2012 Prasad et al.
8,429,182 B2 4/2013 Brackett et al.
8,560,365 B2 10/2013 Friedlander et al.
8,589,136 B2 11/2013 Ertas et al.
8,646,525 B2 2/2014 Izgec et al.
8,688,426 B2 4/2014 Al-Shammari
8,731,892 B2 5/2014 Al-Shammari
8,818,729 B1 8/2014 Stokeld et al.
8,854,373 B2 10/2014 Pessier et al.
8,884,964 B2 11/2014 Holl et al.
8,931,580 B2 1/2015 Cheng et al.
8,968,197 B2 3/2015 Friedlander et al.
8,996,396 B2 3/2015 Benson et al.
9,022,140 B2 5/2015 Marx et al.
9,026,417 B2 5/2015 Sequeira et al.
9,057,258 B2 6/2015 Benson
9,074,468 B1 7/2015 Selman et al.
9,103,195 B2 8/2015 Gawski et al.
9,157,309 B1 10/2015 Benson et al.
9,181,794 B2 11/2015 Oueslati et al.
9,223,594 B2 12/2015 Brown et al.
9,249,654 B2 2/2016 Strachan et al.
9,285,794 B2 3/2016 Wang et al.
9,292,577 B2 3/2016 Friedlander et al.
9,316,100 B2 4/2016 Benson
9,359,882 B2 6/2016 Snyder
9,404,307 B2 8/2016 Maidla
9,404,356 B2 8/2016 Benson et al.
9,436,173 B2 9/2016 Wang et al.
9,462,604 B2 10/2016 Das et al.
9,482,077 B2 11/2016 Yeriazarian et al.
9,489,176 B2 11/2016 Haugen
9,556,728 B2 1/2017 De Reynal, Jr.
9,557,438 B2 1/2017 Wessling et al.
9,587,478 B2 3/2017 Moran et al.
9,593,558 B2 3/2017 Sequeira et al.
9,593,566 B2 3/2017 Hoehn et al.
9,595,129 B2 3/2017 Cheng et al.
9,598,938 B2 3/2017 Colvin et al.
9,613,413 B2 4/2017 Hasselbusch et al.
9,638,032 B2 5/2017 Rath et al.
9,646,271 B2 5/2017 Friedlander et al.
9,733,388 B2 8/2017 Holl et al.
9,784,099 B2 10/2017 Kale et al.
9,874,648 B2 1/2018 Braaksma et al.
9,875,535 B2 1/2018 Finch et al.
9,886,674 B2 2/2018 Friedlander et al.
9,958,571 B2 5/2018 Al-Nuaim et al.
9,970,284 B2 5/2018 Tang et al.
10,018,028 B2 7/2018 Benson et al.
10,024,151 B2 7/2018 Dykstra et al.
10,036,829 B2 7/2018 Ghayour et al.
10,048,396 B2 8/2018 Dobin et al.
10,087,721 B2 10/2018 Usadi et al.
2002/0049575 A1 4/2002 Jalali et al.
2002/0055868 A1 5/2002 Dusevic et al.
2002/0103630 A1 8/2002 Aldred et al.
2003/0074139 A1 4/2003 Poedjono
2004/0046503 A1 3/2004 Geusic
2004/0059554 A1 3/2004 Goldman et al.
2004/0088115 A1 5/2004 Guggari et al.
2004/0220790 A1 11/2004 Cullick et al.
2004/0256152 A1 12/2004 Dashevskiy et al.
2005/0063251 A1 3/2005 Guidry et al.
2005/0121197 A1 6/2005 Lopez et al.
2005/0133259 A1 6/2005 Koederitz
2005/0149306 A1 7/2005 King
2005/0197813 A1 9/2005 Grayson
2005/0199425 A1 9/2005 Estes et al.
2005/0217896 A1 10/2005 Terentyev et al.
2005/0222772 A1 10/2005 Koederitz et al.
2005/0273302 A1 12/2005 Huang et al.
2005/0273304 A1 12/2005 Oliver et al.
2005/0279532 A1 12/2005 Ballantyne et al.
2005/0284661 A1 12/2005 Goldman et al.
2006/0015310 A1 1/2006 Husen et al.
2006/0100836 A1 5/2006 Singh

(56) References Cited

U.S. PATENT DOCUMENTS

| | | | |
|---|---|---|---|
| 2006/0149518 | A1 | 7/2006 | Oliver et al. |
| 2006/0151214 | A1 | 7/2006 | Prange et al. |
| 2006/0161406 | A1 | 7/2006 | Kelfoun |
| 2006/0247903 | A1 | 11/2006 | Schottle et al. |
| 2007/0185696 | A1 | 8/2007 | Moran et al. |
| 2007/0199721 | A1 | 8/2007 | Givens et al. |
| 2008/0133550 | A1 | 6/2008 | Orangi et al. |
| 2008/0300793 | A1 | 12/2008 | Tilke et al. |
| 2009/0132458 | A1 | 5/2009 | Edwards et al. |
| 2009/0141943 | A1 | 6/2009 | Liu |
| 2009/0159336 | A1 | 6/2009 | Boone |
| 2010/0042327 | A1 | 2/2010 | Garvey et al. |
| 2010/0133008 | A1 | 6/2010 | Gawski et al. |
| 2010/0161292 | A1 | 6/2010 | Shook et al. |
| 2010/0250139 | A1 | 9/2010 | Hobbs et al. |
| 2010/0252325 | A1 | 10/2010 | Porche |
| 2011/0024191 | A1 | 2/2011 | Boone |
| 2011/0067119 | A1 | 3/2011 | Baum |
| 2011/0067882 | A1 | 3/2011 | Yeriazarian et al. |
| 2011/0108325 | A1 | 5/2011 | Hartmann et al. |
| 2011/0153300 | A1 | 6/2011 | Holl et al. |
| 2011/0172976 | A1 | 7/2011 | Budiman et al. |
| 2012/0026002 | A1 | 2/2012 | Vu et al. |
| 2012/0035896 | A1 | 2/2012 | Wu et al. |
| 2012/0059521 | A1 | 3/2012 | Iversen et al. |
| 2012/0123757 | A1 | 5/2012 | Ertas et al. |
| 2012/0139747 | A1 | 6/2012 | Papouras et al. |
| 2012/0143899 | A1 | 6/2012 | Arango et al. |
| 2012/0147006 | A1 | 6/2012 | Rothnemer |
| 2012/0272174 | A1 | 10/2012 | Vogel et al. |
| 2012/0274664 | A1 | 11/2012 | Fagnou |
| 2012/0316787 | A1 | 12/2012 | Moran et al. |
| 2013/0032335 | A1 | 2/2013 | Bennett |
| 2013/0087385 | A1 | 4/2013 | Pena |
| 2013/0127900 | A1 | 5/2013 | Pena et al. |
| 2013/0144531 | A1 | 6/2013 | Johnston |
| 2013/0161096 | A1 | 6/2013 | Benson et al. |
| 2013/0179136 | A1 | 7/2013 | Tiwari et al. |
| 2013/0238508 | A1 | 9/2013 | Kok et al. |
| 2013/0341093 | A1 | 12/2013 | Jardine et al. |
| 2014/0000964 | A1 | 1/2014 | Selman et al. |
| 2014/0040324 | A1 | 2/2014 | Marcolino et al. |
| 2014/0070956 | A1 | 3/2014 | Winkler et al. |
| 2014/0151121 | A1 | 6/2014 | Boone et al. |
| 2014/0232723 | A1 | 8/2014 | Jain et al. |
| 2014/0354402 | A1 | 12/2014 | Joao |
| 2014/0362087 | A1 | 12/2014 | Irani et al. |
| 2015/0014056 | A1 | 1/2015 | White et al. |
| 2015/0053482 | A1 | 2/2015 | Boone |
| 2015/0094994 | A1 | 4/2015 | Sequeira et al. |
| 2015/0167454 | A1 | 6/2015 | Kale et al. |
| 2015/0218914 | A1 | 8/2015 | Marx et al. |
| 2015/0240618 | A1 | 8/2015 | Gawski et al. |
| 2015/0285950 | A1 | 10/2015 | Yarus et al. |
| 2015/0346908 | A1 | 12/2015 | Huang et al. |
| 2015/0365635 | A1 | 12/2015 | Jose et al. |
| 2016/0012371 | A1 | 1/2016 | Passolt et al. |
| 2016/0017696 | A1 | 1/2016 | Srinivasan et al. |
| 2016/0025877 | A1 | 1/2016 | Ramfjord et al. |
| 2016/0117424 | A1 | 4/2016 | Hohl et al. |
| 2016/0203681 | A1 | 7/2016 | Nield et al. |
| 2016/0237802 | A1 | 8/2016 | Boone et al. |
| 2016/0290117 | A1 | 10/2016 | Dykstra et al. |
| 2016/0291575 | A1 | 10/2016 | Moore et al. |
| 2016/0314225 | A1 | 10/2016 | Gonzales et al. |
| 2017/0096889 | A1 | 4/2017 | Blankaert et al. |
| 2017/0153358 | A1 | 6/2017 | Hansen |
| 2017/0316128 | A1 | 11/2017 | Huang et al. |
| 2018/0080305 | A1 | 3/2018 | Jacks et al. |
| 2018/0119534 | A1 | 5/2018 | Jamison et al. |
| 2019/0145183 | A1 | 5/2019 | Potash |

FOREIGN PATENT DOCUMENTS

| | | | |
|---|---|---|---|
| CN | 105917074 | A | 8/2016 |
| EP | 2948618 | B1 | 8/2018 |
| GB | 2346628 | A | 8/2000 |
| GB | 2457604 | A | 8/2009 |
| GB | 2534793 | A | 8/2016 |
| GB | 2535039 | A | 8/2016 |
| GB | 2535362 | A | 8/2016 |
| GB | 2547592 | A | 8/2017 |
| RU | 2640607 | C1 | 1/2018 |
| WO | 95/21317 | A2 | 8/1995 |
| WO | 2016/161291 | A1 | 10/2016 |
| WO | 2017/164867 | A1 | 9/2017 |
| WO | 2019/087213 | A1 | 5/2019 |

OTHER PUBLICATIONS

Pessier et al., Drilling Performance is a Function of Power at the Bit and Drilling Efficiency, SPE/IADC Drilling Conference and Exhibition (2012), 16 pages.

Curry et al., The Effect of Borehole Pressure on the Drilling Process in Salt, SPE/IADC Drilling Conference, (2005), pp. 1-8.

Dashevskiy et al., Application of Neural Networks for Predictive Control in Drilling Dynamics, SPE 56442, (1999), 9 pages.

Eronini et al., A Dynamic Model for Rotary Rock Drilling, Journal of Energy Resouces Technology, vol. 104, (Jun. 1982), 14 pages.

Glass, Kevin L., Apparatus and Method for Optimizing the Bit Design for a Well Bore, U.S. Appl. No. 60/163,227, filed Nov. 3, 1999.

Glowka, David A., Development of a Method for Predicting the Performance and Wear of PDC Drill Bits, Dandia Report, (Sep. 1987), 206 pages.

Glowka, David A., Use of Single-Cutter Data in the Analysis of PDC Bit Designs: Part 1 Development of a PDC Cutting Force Model, JPT, (Aug. 1989), pp. 797-849.

Glowka, David A., Use of Single-Cutter Data in the Analysis of PDC Bit Designs: Part 2 Development and Use of the PDCWear Computer Code, JPT, (Aug. 1989), pp. 850-859.

Hanson et al., Dynamics Modeling of PDC Bits, DPE/IADC 29401, (1995), pp. 589-604.

International Search Report for International Application No. PCT/US2019/014777 dated May 1, 2019, 3 pages.

International Written Opinion for International Application No. PCT/US2019/014777 dated May 1, 2019, 6 pages.

Ma et al., The Computer Simulation of the Interaction Between Roller Bit and Rock, SPE 29922, (1995), pp. 309-317.

EARTH-BORING SYSTEMS AND METHODS FOR CONTROLLING EARTH-BORING SYSTEMS

FIELD

This disclosure relates generally to earth-boring systems and methods for controlling earth-boring systems. More specifically, disclosed embodiments relate to earth-boring systems and methods for controlling earth-boring systems that may more accurately set operating parameters for better automated earth-boring control based on more comprehensive evaluation of earth-boring performance and may simplify the display of complex performance metrics and recommended operating parameters to operators to enable better real-time manual control of earth-boring systems.

BACKGROUND

When preparing plans for operating parameters to employ when drilling or expanding a borehole in an earth formation, operators may consult the recorded operating parameters used when drilling at similar depths and through similar formations. The recorded operating parameters may yield little insight when a planned trajectory for a borehole is deeper, or even when a length of a given formation type to be drilled is longer, than the depths and lengths of those boreholes used for comparison purposes. The process of removing earth material may also be characterized by periods of rapid progress intermittently interrupted by periods of slow progress or even stagnation, such that drilling may proceed in fits and starts. In addition, the drilling environment may be chaotic and high-stress, and operational parameters as well as evaluations of drilling efficiency may be many, such that operators may become overwhelmed by demands for their attention. The relationship between operational parameters and drilling performance may not always be straightforward, and operators may not be able to take appropriate action to improve drilling performance even when certain operational parameters and metrics showing drilling performance are made available to the operators.

BRIEF SUMMARY

In some embodiments, systems for automatically and dynamically controlling a drill string for drilling an earth formation may include a length of drill pipe and an earth-boring tool securable to, and rotatable with, the length of drill pipe. A drawworks may be configured to support the length of drill pipe and the earth-boring tool from the drawworks, the drawworks configured to raise and lower the length of drill pipe and to apply a weight on the earth-boring tool. A rotational apparatus may be configured to operatively connect to the length of drill pipe, the rotational apparatus configured to rotate the length of drill pipe and the earth-boring tool at a selectable number of surface rotations per minute. A pump may be configured to connect to the length of drill pipe, the pump configured to control a rate of flow of a drilling fluid through the drill pipe. A control unit including a processing unit and a nontransitory memory device may be operatively connectable to the drawworks, the rotational apparatus, and the pump to receive operational state data from the drawworks, the rotational apparatus, and the pump and to send control signals to the drawworks, the rotational apparatus, the pump, or any combination of these to automatically change the operational state of the drawworks, the rotational apparatus, the pump, or any combination of these. The memory device of the control unit may store software that, when executed by the processing unit of the control unit, causes the control unit to: accept a planned trajectory for the length of drill pipe and the earth-boring tool into the earth formation, the planned trajectory including direction, distance, and earth formation type to be explored; divide the distance of the planned trajectory into a predetermined number of sections, normalizing the distance; at least periodically receive the operational state data from the drawworks, the rotational apparatus, and the pump; at least periodically calculate at least one of a normalized rate of penetration of the length of drill pipe and the earth-boring tool and a normalized mechanical specific energy of a earth-boring operation performed by the length of drill pipe and the earth-boring tool utilizing the operational state data from the drawworks and the normalized distance of the planned trajectory at least in part by dividing a raw rate of penetration or a raw mechanical specific energy by a distance per section; compare the calculated normalized rate of penetration or the calculated normalized mechanical specific energy to a benchmark normalized rate of penetration or a benchmark normalized mechanical specific energy stored in the memory device, the benchmark normalized rate of penetration or the benchmark normalized mechanical specific energy being a highest normalized rate of penetration or a lowest normalized mechanical specific energy in a database of normalized rates of penetration or normalized mechanical specific energies achieved in corresponding sections of other boreholes; and send a control signal to cause the drawworks, the rotational apparatus, the pump, or any combination of these to automatically change a weight applied to the length of drill pipe and the earth-boring tool, a number of surface rotations per minute, a rate of flow of drilling fluid through the drill pipe, or any combination of these to better match a corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or the benchmark normalized mechanical specific energy stored in the database.

In other embodiments, methods of automatically and dynamically controlling a drill string drilling an earth formation may involve lowering a length of drill pipe and an earth-boring tool connected thereto into a borehole, applying weight to the earth-boring tool via the length of drill pipe utilizing a drawworks, and rotating the length of drill pipe and the earth-boring tool utilizing a rotational apparatus. A drilling fluid may be caused to flow through the drill pipe utilizing a pump. A distance of a planned trajectory stored in a nontransitory memory device of a control unit operatively connected to the drawworks, the rotational apparatus, and the pump may be divided into a predetermined number of sections, normalizing the distance, utilizing a processing unit of the control unit, the planned trajectory including a direction, the distance, and an earth formation type to be explored. The drawworks, the rotational apparatus, and the pump may be periodically queried utilizing the control unit and the control unit may receive operational state data from the drawworks, the rotational apparatus, and the pump. At least one of a normalized rate of penetration of the length of drill pipe and the earth-boring tool and a normalized mechanical specific energy of an earth-boring operation performed by the length of drill pipe and the earth-boring tool may be periodically calculated utilizing the operational state data from the drawworks and the normalized distance of the planned trajectory at least in part by dividing a raw rate of penetration or a raw mechanical specific energy by a distance per section. The calculated normalized rate of penetration or the calculated normalized mechanical specific energy may be at least periodically compared to a benchmark normalized rate of penetration or a benchmark normalized mechanical specific energy stored in the memory device, the benchmark normalized rate of penetration or the benchmark normalized mechanical specific energy being a highest normalized rate of penetration or a lowest normalized mechanical specific energy in a database of normalized rates of penetration or normalized mechanical specific energies achieved in corresponding sections of other boreholes. A control signal may at least periodically be sent to cause the drawworks, the rotational apparatus, the pump, or any combination of these to automatically change in real-time a weight applied to the length of drill pipe and the earth-boring tool, a number of surface rotations per minute, a rate of flow of drilling fluid through the drill pipe, or any combination of these to better match a corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or the benchmark normalized mechanical specific energy stored in the database.

In still other embodiments, methods of calculating recommended drilling parameters and dynamically updating an electronic display device may involve lowering a length of drill pipe and an earth-boring tool connected thereto into a borehole, applying weight to the earth-boring tool via the length of drill pipe utilizing a drawworks, and rotating the length of drill pipe and the earth-boring tool utilizing a rotational apparatus. A drilling fluid may be caused to flow through the drill pipe utilizing a pump. A distance of a planned trajectory stored in a nontransitory memory device of a control unit operatively connected to the drawworks, the rotational apparatus, and the pump may be divided into a predetermined number of sections, normalizing the distance, utilizing a processing unit of the control unit, the planned trajectory including a direction, the distance, and an earth formation type to be explored. The drawworks, the rotational apparatus, and the pump may be at least periodically queried utilizing the control unit and operational state data may be received from the drawworks, the rotational apparatus, and the pump at the control unit. At least one of a normalized rate of penetration of the length of drill pipe and the earth-boring tool and a normalized mechanical specific energy of a earth-boring operation performed by the length of drill pipe and the earth-boring tool may be periodically calculated utilizing the operational state data from the drawworks and the normalized distance of the planned trajectory at least in part by dividing a raw rate of penetration or a raw mechanical specific energy by a distance per section. The calculated normalized rate of penetration or the calculated normalized mechanical specific energy may be at least periodically compared to a benchmark normalized rate of penetration or a benchmark normalized mechanical specific energy stored in the memory device, the benchmark normalized rate of penetration or the benchmark normalized mechanical specific energy being a highest normalized rate of penetration or a lowest normalized mechanical specific energy in a database of normalized rates of penetration or normalized mechanical specific energies achieved in corresponding sections of other boreholes. A control signal may be at least periodically sent from the control unit to an electronic display device, causing the electronic display device to display, in real time, the weight applied to the length of drill pipe and the earth-boring tool, the number of surface rotations per minute, the rate of flow of drilling fluid through the drill pipe, or any combination of these and a corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or the benchmark normalized mechanical specific energy when the software is executed by the processing unit of the control unit.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

Figure 1:
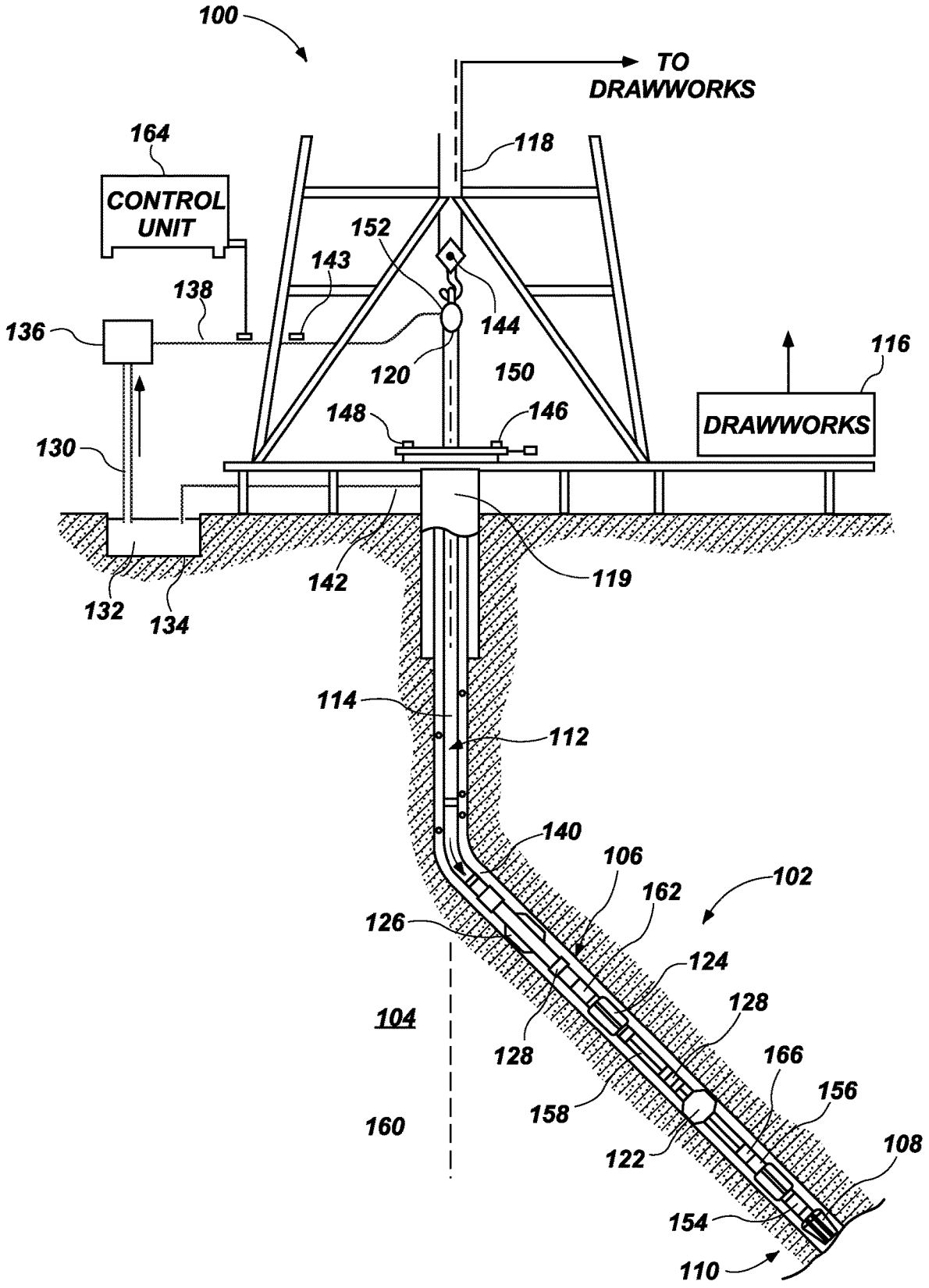
FIG. 1 is a simplified schematic side view of a earth-boring system for an earth-boring operation.

The illustrations presented in this disclosure are not meant to be actual views of any particular earth-boring system, control unit, graphical user interface, or component thereof, but are merely idealized representations employed to describe illustrative embodiments. Thus, the drawings are not necessarily to scale.

Disclosed embodiments relate generally to earth-boring systems and methods for controlling earth-boring systems that may more accurately set operating parameters for better automated earth-boring performance based on more comprehensive evaluation of earth-boring performance and may simplify the display of complex performance metrics and recommended operating parameters to operators to enable better real-time manual control of earth-boring systems. More specifically, disclosed are embodiments of earth-boring systems and methods for controlling earth-boring systems that may involve normalizing drilling distances by breaking wellbores, or distinct lengths of formation type to be drilled, into a uniform number of segments. Drilling performance may be calculated, normalized, and compared segment-by-segment, rather than by absolute distance, to determine whether an actual earth-boring operation is performing better than, as well as, or worse than other, prior earth-boring operations completed in the same segment.

Automated drilling systems may then adjust actual, normalized operational parameters to better match the normalized operational parameters that achieved better performance or may update the benchmarks to reflect the operational parameters currently achieving best performance. Normalized performance and normalized operational parameters may also be shown against the benchmark and updated in real time to enable operators to better understand the complex relationships between their actions and resulting performance, and take appropriate action to improve performance.

As used herein, the terms "substantially" and "about" in reference to a given parameter, property, or condition means and includes to a degree that one of ordinary skill in the art would understand that the given parameter, property, or condition is met with a degree of variance, such as within acceptable manufacturing tolerances. For example, a parameter that is substantially or about a specified value may be at least about 90% the specified value, at least about 95% the specified value, at least about 99% the specified value, or even at least about 99.9% the specified value.

The term "earth-boring tool," as used herein, means and includes any type of bit or tool used for aggressive (i.e., earth-removing), nonaggressive (i.e., sliding, non-earth-removing), or a combination of aggressive and nonaggressive contact with earth material during the formation or enlargement of a wellbore in a subterranean formation. For example, earth-boring tools include fixed-cutter bits, roller-cone bits, core bits, eccentric bits, bicenter bits, reamers, stabilizers, mills, hybrid bits including both fixed and rotatable cutting structures, and other drilling bits and tools known in the art.

The term "mechanical specific energy," as used herein, means and includes the quantity of energy expended per unit volume of earth material removed during an earth-boring operation.

FIG. 1 is a simplified schematic side view of an earth-boring system 100 for an earth-boring operation. The earth-boring system 100 may include a bottom-hole assembly 102 that may be deployable in an earth formation 104 to form or enlarge a borehole 106 in the earth formation 104. The bottom-hole assembly 102 may include an earth-boring tool 108 located at a leading end 110 of the bottom-hole assembly 102. The earth-boring tool 108 may be configured to engage with and remove an underlying earth formation in response to application of axial force and rotational torque via a drill string 112 to which the bottom-hole assembly 102 may be connected. The drill string 112 may include a length of drill pipe 114 comprising sections of tubular members interconnected to one another and to the bottom-hole assembly 102. The drill string 112 may be supported by, and suspended from, a drawworks 116 located at a surface of the earth formation 104 (or on a surface of a body of water for offshore drilling). For example, the drawworks 116 may have a kelly joint 118 and a swivel 120, which may be configured to apply axial force (e.g., weight on bit) and a rotary table 119 configured to apply rotational torque to the drill string 112 to rotate earth-boring tool 108. Of course, a top drive, as known to those of ordinary skill in the art, may be utilized in lieu of rotary table 119 and swivel 120; thus, as used herein, the term "rotational apparatus" means and includes alternative apparatus of applying rotational torque under weight on bit to a drill string, including without limitation a top drive and associated components. While a land-based earth-boring system is shown, the equipment and methods described in connection with this disclosure are equally applicable to offshore earth-boring systems.

The earth-boring system 100 my include a hook load sensor 144 (e.g., utilizing a strain gauge) associated with the drawworks 116 (e.g., connected to the kelly joint 118) and configured to generate and send a signal indicative of the weight applied to the drill pipe 114 and the earth-boring tool 108 utilizing the drawworks 116. The earth-boring system 100 may also include a rate of advancement sensor 146 (e.g., utilizing an infrared sensor) associated with the drawworks 116 (e.g., connected to the swivel 120) and configured to generate and send a signal indicative of the rate of penetration (i.e., the distance by which the drill string 112 advances into the earth formation 104 per unit of time). The earth-boring system 100 may further include a rotational speed sensor 148 (e.g., utilizing another infrared sensor or the same infrared sensor as the rate of advancement sensor 146) associated with the rotational apparatus (e.g., located proximate to the top drive 119 at an entrance 150 to the borehole 106) and configured to generate and send a signal indicative of the number of surface rotations per unit of time (e.g., the number of times the drill pipe 114 makes a complete, 360° rotation per minute).

In some embodiments, the earth-boring system 100 may include one or more other optional sensors for detecting various operational parameters of the drill string 112 or environmental conditions of the borehole 106 or earth formation 104. For example, the earth-boring system 100 may include a torque sensor 152 associated with the drawworks 116 and configured to generate and send a signal indicative of a torque applied to the drill pipe 114 and the earth-boring tool 108 utilizing the drawworks 116. The earth-boring system 100 may include a differential pressure sensor 154 associated with the drill string 112 (e.g., for positioning within the borehole 106) and configured to generate and send a signal indicative of a differential pressure between the drilling fluid 132 and formation fluids located within the earth formation 104. The earth-boring system 100 may include a gamma radiation sensor 156 associated with the drill string 112 (e.g., for positioning within the borehole 106) and configured to generate and send a signal indicative of a quantity of gamma radiation emitted by a downhole earth formation 104. The earth-boring system 100 may include an inclination sensor 158 associated with the length of drill pipe 114 (e.g., for positioning within the borehole 106) and configured to generate and send a signal indicative of an angle of inclination of the length of drill pipe 114 relative to a vertical axis 160 (i.e., relative to an axis intersecting a center of the borehole 106 at the entrance 150 and a geometrical center of the planet Earth). The earth-boring system 100 may include an azimuth sensor 162 associated with the length of drill pipe 114 and configured to generate and send a signal indicative of a direction of the borehole 106 relative to a reference direction on a horizontal plane (e.g., as measured in degrees relative to a vector pointing toward true north on a plane at least substantially perpendicular to the vertical axis 160). The earth-boring system 100 may include any one, or any combination or subcombination, of the optional sensors described in this paragraph.

In some embodiments, the bottom-hole assembly 102 may include one or more other components in addition to, or instead of, the earth-boring tool 108. For example, the bottom-hole assembly 102 may include a reamer 122 (expandable or fixed) located in the drill string 112 above the earth-boring tool 108, a motor 124 (e.g., a Moineau-type mud motor) located in the drill string 112 above the earth-boring tool 108 and/or the reamer 122, one or more stabilizers 126 (expandable or fixed) located in the drill string 112 above the earth-boring tool 108, the reamer 122, and/or the motor 124.

One or more sensor subs 128 for deployment within the borehole 106 may be operatively coupled to the drill string 112. The sensor subs 128 may be configured to detect one or more downhole conditions, such as, for example, elevation, position, orientation, acceleration, speed, temperature, pressure, formation type, presence of threshold concentration of specified fluids (e.g., oil), or any combination or subcombination of these. Each sensor sub 128 may include, for example, at least one of a spatial sensor (e.g., an accelerometer, a magnetometer, a gyroscope, etc.), temperature sensor, pressure sensor, elevation sensor, acoustic sensor, electromagnetic wave sensor (e.g., radio frequency, infrared, light, ultraviolet, etc.), or any combination or subcombination of these.

The earth-boring system 100 may include a pump 130 configured to circulate drilling fluid 132 from a source 134 through the drill string 112. For example, the drilling fluid 132 may flow under pressure from the pump 130 into the length of drill pipe 114 of the drill string 112 via a desurger 136, fluid line 138, and the kelly joint 118. The drilling fluid 132 may be discharged within the borehole, for example, through nozzles in the earth-boring tool 108, the reamer 122, or both, which may aid in removing cuttings of earth material and cooling downhole components. The drilling fluid 132 may circulate uphole through the annulus 140 between the drill string 112 and sidewalls of the borehole 106, and a return line 142 may return the drilling fluid 132 to the source 134 for optional removal of cuttings and recirculation. A flow rate sensor 143 in communication with the drilling fluid 132 (e.g., located in the fluid line 138 between the pump 130 and the kelly joint 118) may detect the rate at which the drilling fluid 132 flows through the drill string 112. In some embodiments, the flow rate sensor 143 may further be configured to detect a pressure of the drilling fluid 132 proximate to an output of the pump 130.

A control unit 164 may be operatively connected to the various sensors subs 128 and sensors 143, 144, 146, 148, 152, 154, 156, 158, and 162, and may receive the signals they generate and send. For example, the earth-boring system 100 may include a wellbore communication system 166 configured to enable signals from any downhole sensor subs 128 or other downhole sensors 154, 156, 158, and 162 to be transmitted from within the borehole 106 to the control unit 164 at a surface of the earth-boring system 100. By way of non-limiting example, the wellbore communication system 166 may include any of a mud pulse telemetry system, a radio frequency signal telemetry system, an electromagnetic telemetry system, an acoustic signal telemetry system, a wired-pipe telemetry system (e.g., including electrical conductors, optical fibers, or a combination thereof), a galvanic telemetry system, or combinations thereof. The drill string 112 may include power and/or data conductors such as wires for providing bi-directional communication and power transmission. The conductors may be adapted to convey electrical signals, optical signal, and/or electrical power. The control unit 164 may also be operatively connected to those sensors 143, 144, 146, 148, and 152 located at the surface, outside the borehole 106, by a wireless, wired, or combination of wireless and wired connections.

The control unit 164 may be configured to provide a simplified, real-time display of at least certain metrics for evaluating the performance of the earth-boring system 100, as well as a real-time comparison between current operational parameters of the earth-boring system 100 and operational parameters that achieved the best known performance of an earth-boring system, optionally filtered for similar systems and/or comparable earth-formations. In some embodiments involving automated control of the earth-boring system 100, the control unit 164 may be configured to send control signals to the drawworks 116, the rotational apparatus (e.g., the top drive 119), and/or the pump 130 to change at least one of the weight applied to the length of drill pipe 114 and the earth-boring tool 108, the number of surface rotations per minute, and the flow rate of drilling fluid 132 to better match the corresponding operational parameters that achieved the best known performance of an earth-boring system, optionally filtered for similar systems and/or comparable earth-formations, normalizing the metrics for evaluating performance and the operational parameters to better control the earth-boring system 100.

Figure 2:
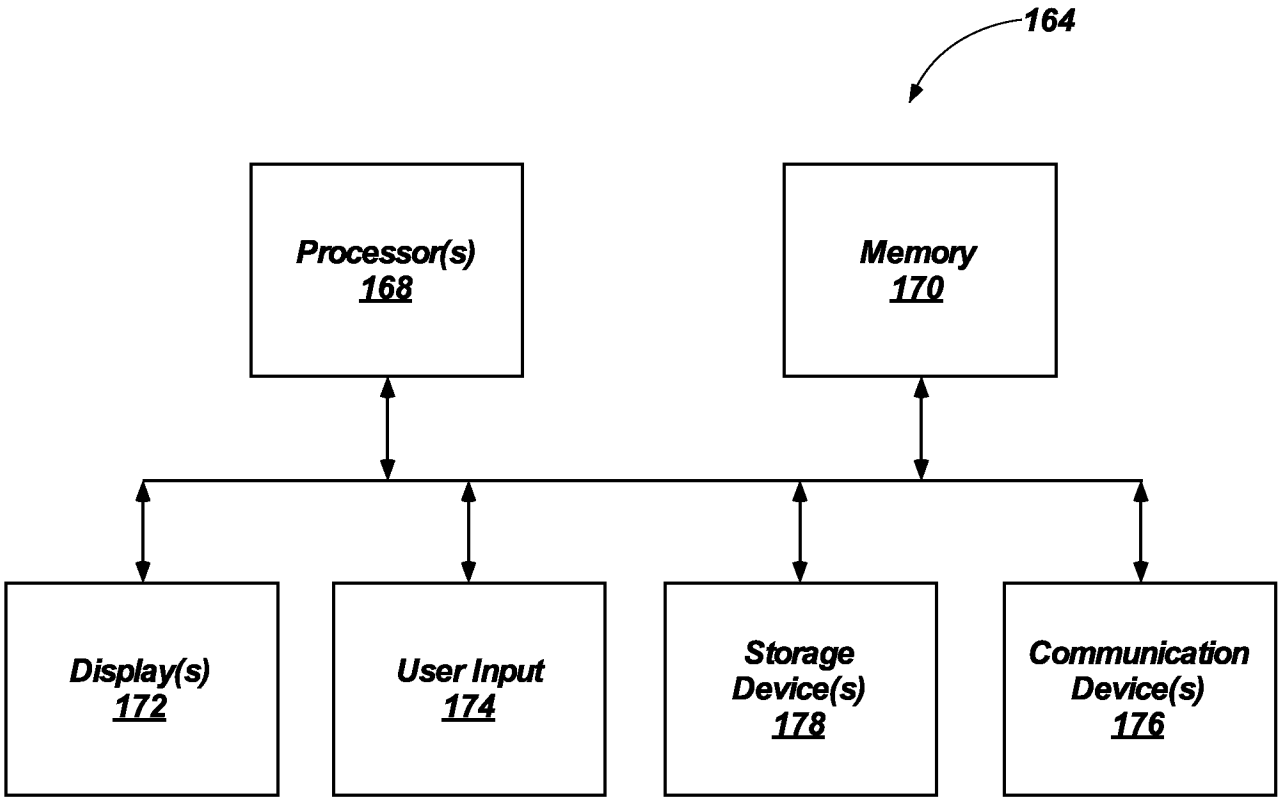
FIG. 2 is a simplified schematic view of a control unit of the earth-boring system of FIG. 1.

FIG. 2 is a simplified schematic view of a control unit 164 of the earth-boring system 100 of FIG. 1. The control unit 164 may include, for example, a user-type computer, a file server, a computer server, a notebook computer, a tablet, a handheld device, a mobile device, or other similar computer system for executing software and displaying the results of executed software. The control unit 164 may be configured to execute software programs containing computing instructions and may include one or more processing units 168, nontransitory memory devices 170, electronic display devices 172, user input devices 174, communication devices 176, and nontransitory storage devices 178.

The processing unit 168 or processing units 168 may be configured to execute a wide variety of operating systems and applications including the computing instructions described in connection with this disclosure. The processing unit 168 may be configured as a processor, microprocessor, controller, microcontroller, or state machine suitable for carrying out processes of this disclosure. The processing unit 168 may also be implemented as a combination of computing devices, such as a combination of a DSP and a microprocessor, a plurality of microprocessors, one or more microprocessors in conjunction with a DSP core, or any other such configuration.

The memory device 170 may be used to hold computing instructions, data, and other information for performing a wide variety of tasks including those computing instructions of this disclosure. By way of example, and not limitation, the memory device 170 may include Synchronous Random Access Memory (SRAM), Dynamic RAM (DRAM), Read-Only Memory (ROM), Flash memory, and the like.

The electronic display device 172 may include, for example, light-emitting diode displays, liquid crystal displays, cathode ray tubes, and the like. In addition, the electronic display device 172 may be configured with a touch-screen feature for accepting user input as a user input device 174.

As nonlimiting examples, the user input device 174 may include elements such as displays, keyboards, push-buttons, mice, joysticks, haptic devices, microphones, cameras, and touchscreens.

The communication device 176 may be configured for communicating with other devices or communication networks. As nonlimiting examples, the communication devices 176 may include elements for communicating on wired and wireless communication media, such as for example, serial ports, parallel ports, Ethernet connections, universal serial bus (USB) connections, IEEE 1394 (FIREWIRE®) connections, THUNDERBOLT™ connections, BLUETOOTH® wireless networks, ZigBee wireless networks, 802.11 type wireless networks, cellular telephone/data networks, and other suitable communication interfaces and protocols.

The storage device 178 may be used for storing relatively large amounts of nonvolatile information for use in the control unit 164 and may be configured as one or more storage devices 178. By way of example and not limitation, these storage devices 178 may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

A person of ordinary skill in the art will recognize that the control unit 164 may be configured in many different ways with different types of interconnecting buses between the various elements. Moreover, the various elements may be subdivided physically, functionally, or a combination thereof. As one nonlimiting example, the memory device 170 may be divided into cache memory, graphics memory, and main memory. Each of these memories may communicate directly or indirectly with the one or more processing units 168 on separate buses, partially combined buses, or a shared bus. As a specific, nonlimiting example, various methods and features of the present disclosure may be implemented in a mobile, remote, or mobile and remote environment over one or more of Internet, cellular communication (e.g., Broadband), near field communication networks and other communication networks.

Figure 3:
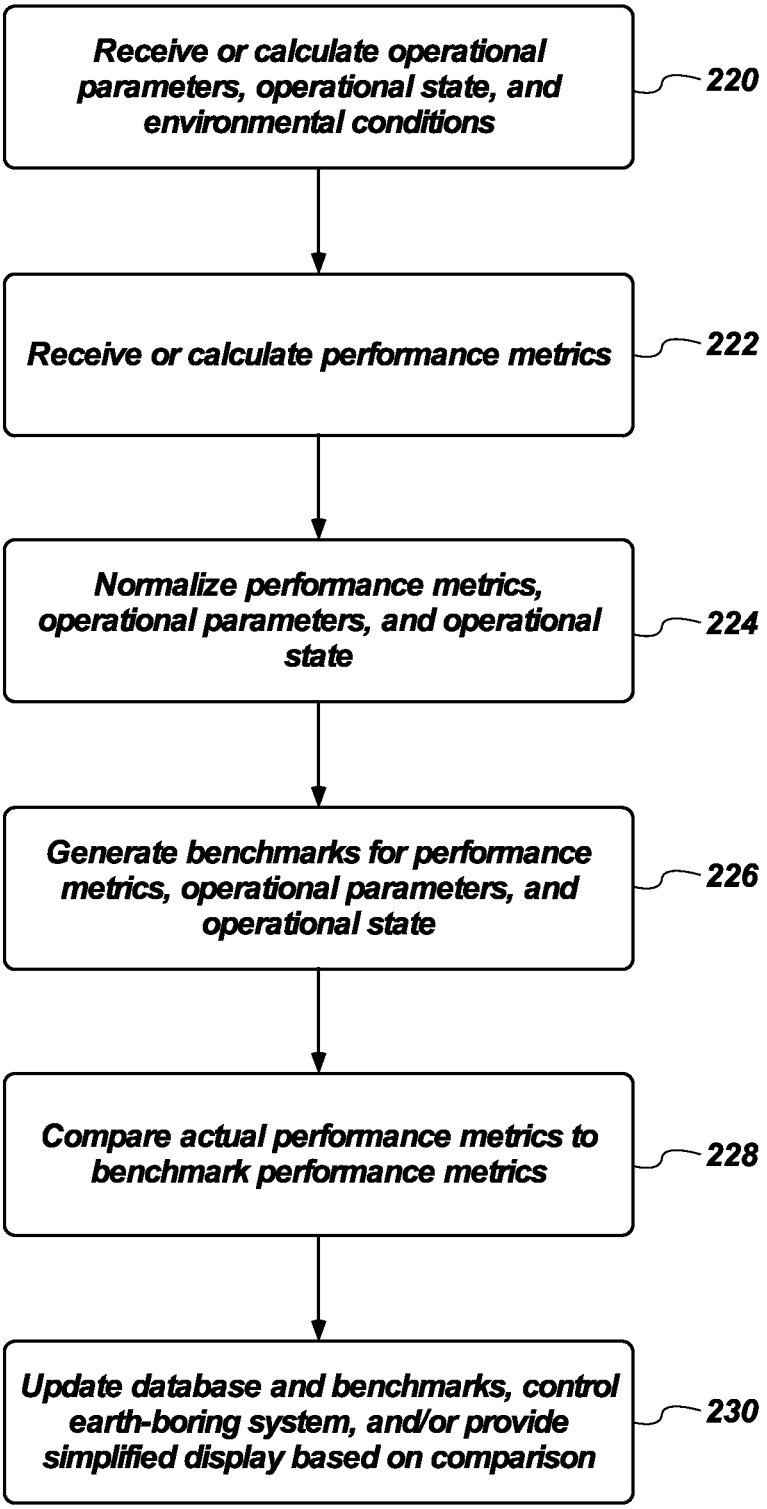
FIG. 3 is a flowchart of a method of automatically controlling, and displaying simplified, detailed information to operators for manual control, of the earth-boring system of FIG. 1.

FIG. 3 is a flowchart of a method of automatically controlling, and displaying simplified, detailed information to operators for manual control, of the earth-boring system of FIG. 1. The control unit 164 (see FIG. 2) may receive at least the operational parameters of, the operational state of, and the environmental conditions around the earth-boring system 100 (see FIG. 1), as indicated at act 220. For example, the operational parameters, the operational state, and the environmental conditions may be directly indicated by, or indirectly calculated from, the signals from the various sensor subs 128 and the sensors 143, 144, 146, 148, 152, 154, 156, 158, and 162 (see FIG. 1). As the control unit 164 (see FIG. 2) receives the signals from the various sensor subs 128 and the sensors 143, 144, 146, 148, 152, 154, 156, 158, and 162 (see FIG. 1), the control unit 164 may store information derived from the signals in the memory device 170 locally and/or via transmission to a remote server utilizing the communication device 176 (see FIG. 2). The control unit 164, locally and/or using the remote server, may generate, and may optionally update in real-time, a database associating the various indicators of the operational state of the drill string 112 (see FIG. 1) and of the environmental conditions in the borehole 106 and the earth formation 104 (see FIG. 1) with a particular earth-boring operation performed on a given date. More specifically, the database may track the operating parameters, position, orientation, and equipment configuration of the drill string 112 (see FIG. 1) at least periodically, and optionally continuously, associating those operating parameters, positions, and orientations with specific times over the time period during which the earth-boring operation is performed. The database may store the foregoing data for many earth-boring operations for generation of benchmarks, recommendations for earth-boring plans, automated control of earth-boring systems 100 (see FIG. 1) and simplified display of complex information to operators.

Figure 4:
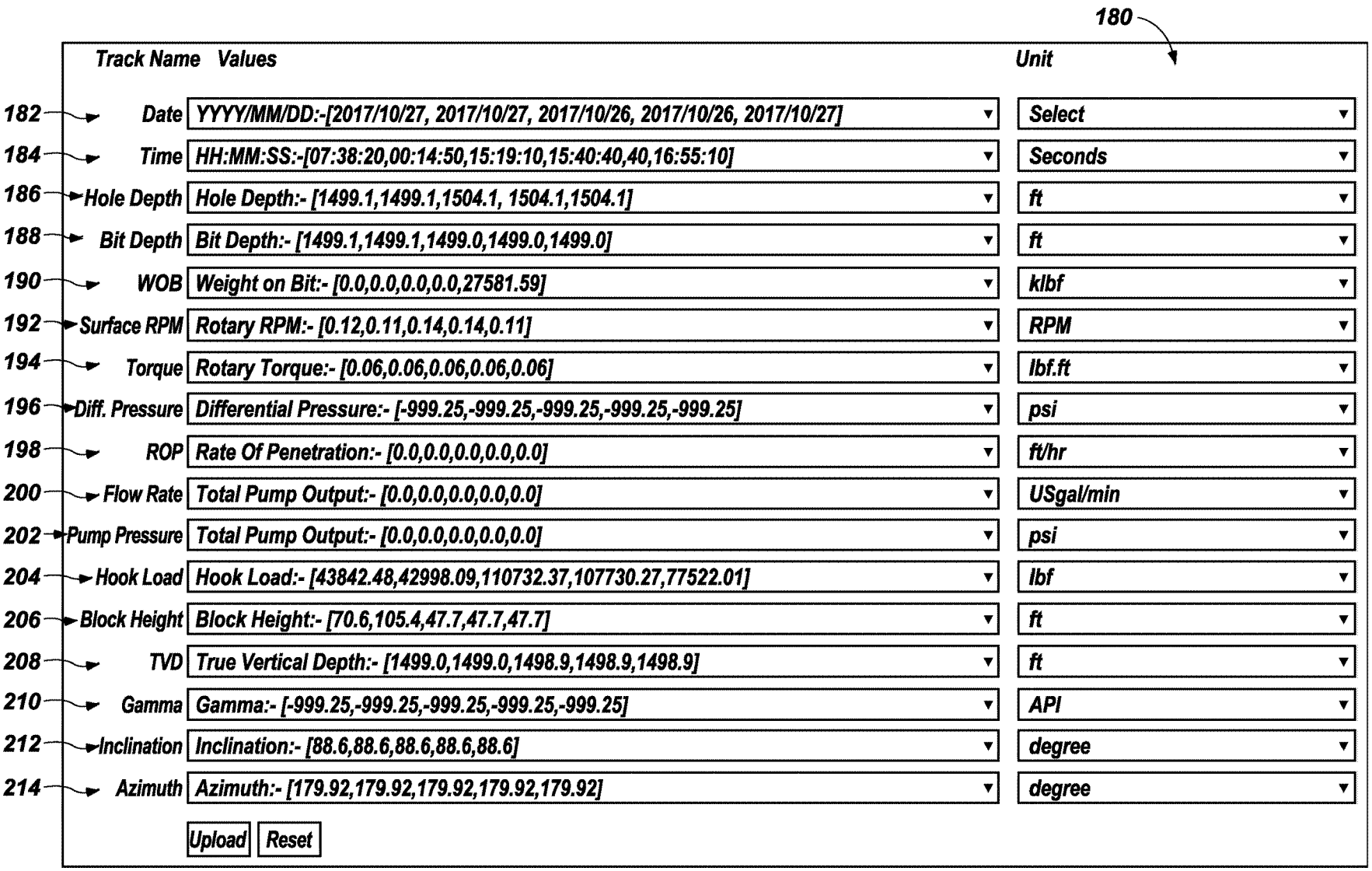
FIG. 4 is still depiction of a menu in a graphical user interface outputtable by the control unit of FIG. 1.

FIG. 4 is still depiction of a menu in a graphical user interface 180 (GUI) outputtable by the control unit 164 of FIG. 1. The control unit 164 may collect or calculate various indicators of the operational state of the earth-boring system 100 and downhole conditions in the borehole 106 (see FIG. 1) in real-time utilizing the signals from the sensor subs 128 and the sensors 143, 144, 146, 148, 152, 154, 156, 158, and 162. The control unit 164 may associate such indicators with a particular earth-boring operation, performed on a given date (shown in a date field 182 in the GUI 180), over a specified time period (shown in a time field 184 in the GUI 180). The control unit 164 may also collect or calculate, for example, the maximum depth of the borehole 106 (see FIG. 1) (shown in hole depth field 186 in the GUI 180), the location of the earth-boring tool 108 (see FIG. 1) (shown in bit depth field 188 in the GUI 180), the weight applied to the length of drill pipe 114 and the earth-boring tool 108 utilizing the drawworks 116 (see FIG. 1) (shown in the weight-on-bit (WOB) field 190 in the GUI 180), the number of rotations per unit of time made by the length of drill pipe 114 (see FIG. 1) at the surface (shown in the surface rotations per minute (RPM) field 192 in the GUI 180), a torque applied to the length of drill pipe 114 at the surface (shown in the torque field 194 in the GUI 180), a differential pressure between the drilling fluid 132 within the borehole 106 and formation fluids within the earth formation 104 (see FIG. 1) (shown in the differential pressure field 196 in the GUI 180), a distance by which the drill string 112 advances into the borehole per unit of time (as shown in the rate of penetration (ROP) field 198 in the GUI 180), a volume of drilling fluid flowing through a cross-section of the length of drill pipe 114 (see FIG. 1) per unit of time (as shown in a flow rate field 200 in the GUI 180), a pressure of the drilling fluid 132 proximate to the pump 130 (as shown in a pressure field 202 in the GUI 180), a total weight borne by the drawworks 116 (see FIG. 1) (as shown in a hook load field 204 in the GUI 180), a height of the length of drill pipe 114 above the entrance 150 to the borehole 106 (see FIG. 1) (as shown in a block height field 206 in the GUI 180), a vertical depth of the borehole, as measured in a direction parallel to the vertical axis 160 (see FIG. 1) (as shown in a true vertical depth field 208 in the GUI 180), an intensity of gamma radiation within the borehole 106 (see FIG. 1) (as shown in a gamma field 210 in the GUI 180), an angle of inclination of the borehole 106 (see FIG. 1) (as shown in an inclination field 212 in the GUI 180), and an azimuth of the borehole 106 (see FIG. 1 (as shown in an azimuth field 214 in the GUI 180). The control unit 164 (see FIG. 2) may, for example, at least periodically query at least those sensors 143, 144, 146, 148, and 152 associated with the drill pipe 114 and the pump 130 utilizing the control unit 164 (see FIG. 1) and receiving operational state data from the sensors 143, 144, 146, 148, and 152 associated with the drill pipe 114 and the pump 130 at the control unit 164 (see FIG. 1).

The indicators, and particularly those indicators involving an element of distance, may be initially detected and calculated in absolute terms. For example, the hole depth field 186, bit depth field 188, rate of penetration field 198, block height field 206, and true vertical depth field 208 may be expressed in terms or, or at least including, absolute distance (e.g., feet or feet per hour). Before automatically controlling the earth-boring system 100, or presenting the indicators to an operator, the control unit 164 may normalize at least some of the indicators, enabling better automatic control and presentation of simplified performance evaluation and recommendations to an operator, as described in greater detail below. In some embodiments, each field 182 through 214 may have a corresponding unit selector, enabling a user to change which absolute, non-normalized units are displayed (e.g., feet, yards, etc.) and/or toggle between the absolute, non-normalized units and normalized units.

Returning to FIG. 3, the control unit 164 may at least periodically record (e.g., receive as a signal or calculate from a received signal or signals), locally or utilizing the remote server, a real-time metric indicative of the performance of the earth-boring system 100 (see FIG. 1), as shown at act 222. The real-time metric may include, for example, receiving a rate of penetration of the earth-boring system 100 from the rate of advancement sensor 146 (see FIG. 1), calculating a mechanical specific energy of the earth-boring system 100 (e.g., utilizing torque and weight on bit detected at the surface to calculate a surface mechanical specific energy or utilizing downhole torque and/or differential pressure to calculated a downhole mechanical specific energy), receiving or calculating a measurement of borehole quality (e.g., calculating a smoothness of the wall of the borehole 106 or a difference between a targeted diameter of the borehole 106 and an actual diameter of the borehole 106), calculating a measurement of cost-effectiveness of the earth-boring operation (e.g., factoring in time, downtime, rate of penetration, energy input, required personnel and associated salaries, or any combination or subcombination of these), or calculating any combination or subcombination the foregoing, individual real-time metrics (e.g., by assigning relative weights to each individual real-time metric for use in a ranking comparison). At least initially, the real-time metric may be in absolute, non-normalized units, such as, for example, feet per hour (for rate of penetration), foot-pound force per cubic foot (for mechanical specific energy), feet or variation in inches per foot (for borehole quality), or dollars per foot (for cost-effectiveness).

At least as often as the control unit 164 directly records, or instructs the remote server to record, the real-time performance metric, the control unit 164 may directly normalize, or instruct the remote server to normalize, the performance metric, operational parameters, and operational state, as indicated at act 224, at least with respect to distance. For example, the control unit 164, locally or utilizing or the remote server, may calculate an average (i.e., a mean) well depth by adding the absolute, non-normalized depths of all the boreholes in the database (and optionally the planned absolute, non-normalized depth of the current borehole 106 (see FIG. 1)), dividing the sum by the total number of boreholes in the database (and optionally including the borehole 106 currently being formed or enlarged) to generate a benchmark borehole having the average depth. The benchmark borehole may be divided into a dynamically calculated number of sections by dividing the average depth assigned to the benchmark borehole by a fixed, predetermined distance and rounding to the nearest whole number. For example, when the average depth assigned to the benchmark borehole is expressed in feet, the average depth may be divided by between 10 feet and 50 feet (e.g., 20 feet) to generate the number of sections. As a specific, nonlimiting example, where the average depth of the benchmark borehole is 1,000 feet, the predetermined number of sections used as part of the normalization techniques of this disclosure may be 50.

Once the number of sections has been predetermined, each borehole in the database may be divided into the same, predetermined number of sections, resulting in sections of different absolute distances for boreholes having different absolute lengths. The real-time performance metric, stored performance metrics from previously formed or enlarged boreholes, and indicators associated with each borehole may likewise be normalized, particularly those indicators involving an element of distance. For example, for each borehole, the absolute distance per normalized section may be used to normalize the real-time performance metric, stored performance metrics from previously formed or enlarged boreholes, and indicators associated with each borehole. More specifically, the real-time performance metric, stored performance metrics from previously formed or enlarged boreholes, and indicators associated with each borehole may be divided by the distance per section for a given borehole to generate a normalized real-time performance metric, normalized stored performance metrics from previously formed or enlarged boreholes in the database, and normalized operational parameters and operational state data for each borehole.

Benchmarks for at least the normalized performance metrics, normalized operational parameters, and normalized operational state may be generated by the control unit (see FIG. 2), as shown at act 226. For example, a benchmark borehole may be generated by comparing the normalized stored performance metrics for all relevant boreholes in the database to one another, and identifying an earth-boring operation that achieved the best performance of any earth-boring operation in the database. More specifically, the benchmark normalized rate of penetration or the benchmark normalized mechanical specific energy for each section in the benchmark borehole may be, for example, a highest normalized rate of penetration or a lowest normalized mechanical specific energy in the database of normalized rates of penetration or normalized mechanical specific energies achieved in corresponding sections of other boreholes. The benchmark borehole may be a theoretical best-formed borehole generated by forming a composite borehole from the sections in the database, pulled from the same earth-boring operation or different earth-boring operations, where the best performance metrics were achieved. More specifically, the benchmark normalized rate of penetration or the benchmark normalized mechanical specific energy may be a highest normalized rate of penetration or a lowest normalized mechanical specific energy in the database of normalized rates of penetration or normalized mechanical specific energies achieved in corresponding sections of other boreholes for each section in the benchmark borehole. The database may associate the operating parameters for, operational state of, and equipment configuration for the earth-boring system that actually formed or enlarged each section, as well as the earth formation type and other environmental data for each section, with respective sections when combining the sections into the benchmark borehole. The database may also associate the absolute, non-normalized performance metrics and normalized performance metrics for respective sections with those individual sections.

In some embodiments, one or more categorical filters may be applied to the database as part of the normalization process. For example, categorical filters may include equipment configuration and earth formation type. More specifically, application of one or more categorical filters may result in, for example, filtering from the database those data entries associated with earth formations different from an earth formation in which the earth-boring tool is located, leaving only those data entries associated with earth formations the same as the earth formation in which the earth-boring tool is located in the filtered database. As another specific, nonlimiting example, application of one or more categorical filters may result in, for example, filtering from the database those data entries associated with drill string equipment selections and configurations different from a drill string equipment selections and configurations currently deployed in the borehole, leaving only those data entries associated with drill string equipment selections and configurations the same as the drill string equipment selections and configurations currently being employed in the filtered database. The benchmark normalized performance metric may then be selected to be, for example, the highest normalized rate of penetration or the lowest normalized mechanical specific energy in the filtered database, such that sections for the benchmark borehole are selected from the filtered database.

When the benchmark borehole is generated before commencing the earth-boring operation, an earth-boring plan may concurrently be generated utilizing the operating parameters associated with the benchmark borehole. For example, an earth-boring plan including at least a recommended weight to applied to the length of drill pipe and the earth-boring tool, a recommended number of surface rotations per minute, and a recommended rate of flow of drilling fluid through the drill pipe when following the planned trajectory may be generated by identifying the weight applied to the length of drill pipe and the earth-boring tool, the number of surface rotations per minute, and the rate of flow of drilling fluid through the drill pipe associated with the benchmark normalized rate of penetration or the benchmark normalized mechanical specific energy.

Figure 5:
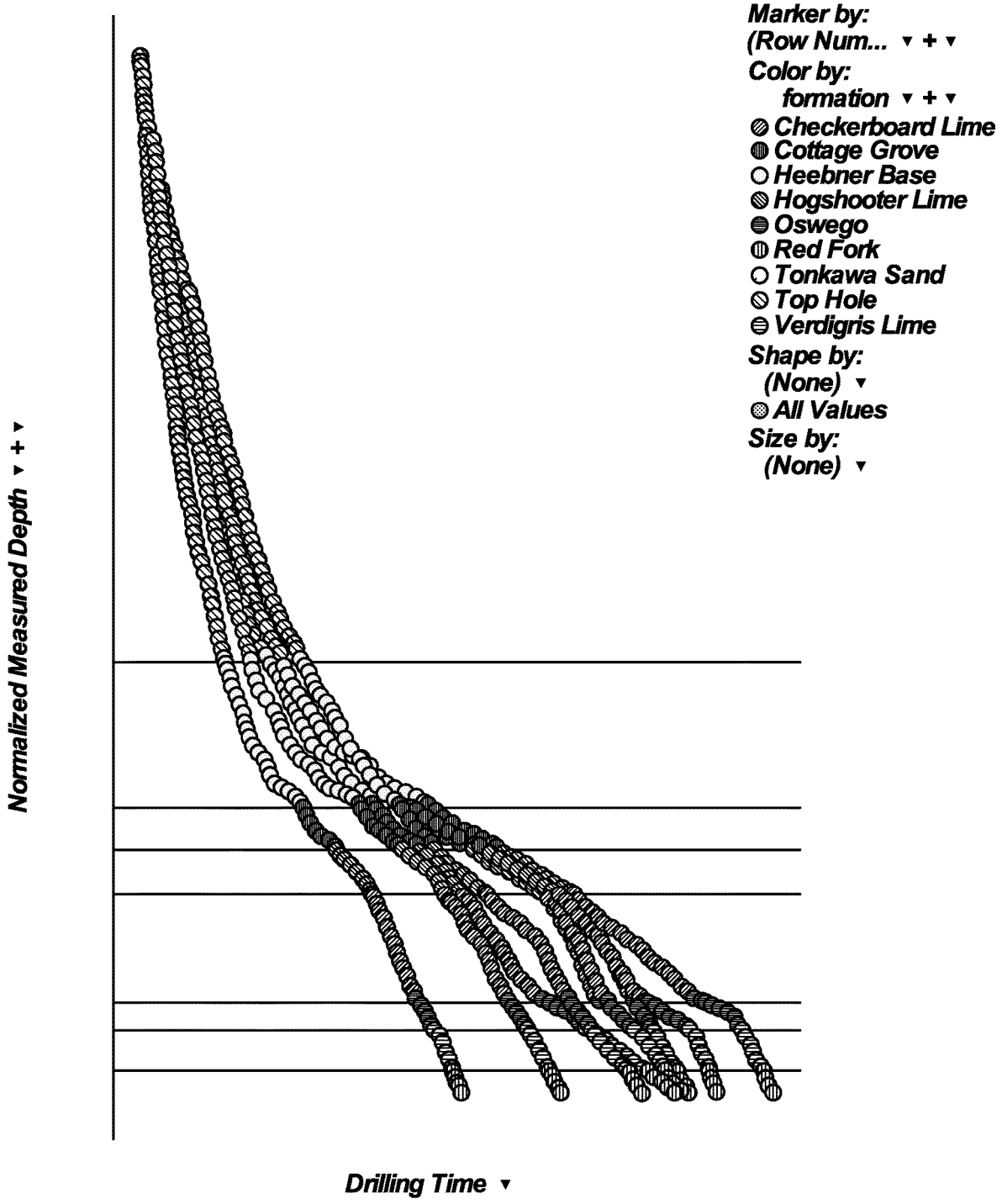
FIG. 5 is a chart showing normalized data stored in a database accessible to, and outputtable by, the control unit of FIG. 1.

FIG. 5 is a chart showing normalized data stored in a database accessible to, outputtable by, and optionally modifiable by the control unit 164 of FIG. 1. The results of normalizing depth (i.e., the sections into which each borehole is divided) against time through various types of earth formation after filtering the data base for each formation type are specifically depicted in FIG. 4. If the raw, pre-normalization data were plotted, the absolute depth at which each earth formation type ends, and at which each earth formation type following the first formation type begins, would differ. By normalizing the data with respect to distance, techniques in accordance with this disclosure ensure that starting sections are evaluated relative to starting sections, midsections are evaluated relative to midsections, end sections are evaluated relative to end sections, and so on, regardless of absolute depth and differences in absolute length of boreholes and regions of a given earth formation type.

A distance of a planned trajectory stored in the memory device 170 of the control unit 164 (see FIG. 2) may also be divided into the predetermined number of sections, normalizing the distance, utilizing the processing unit 168 of the control unit 164 (see FIG. 2), locally or utilizing the remote server. The planned trajectory may include at least a direction, a distance, and one or more earth formation types expected, or known, for exploration when forming or enlarging the borehole 106 (see FIG. 1). More specifically, the planned trajectory may include, for example, absolute depth, diameter, azimuth, inclination, earth formation type, thickness of earth formation type, fluids within the earth formation, and other data associated with the planned trajectory for the borehole 106 (see FIG. 1). The planned trajectory may be accepted via input by a user utilizing the user input device(s) 174 (see FIG. 2), or may be accepted as a predefined data file.

Returning again to FIG. 3, the control unit 164 (see FIG. 2), locally or utilizing the remote server, may at least periodically compare the actual normalized performance metrics to the normalized benchmark performance metrics from the benchmark borehole, as shown at act 228. More specifically, the control unit 164 (see FIG. 2) may at least periodically compare, for example, the calculated, actual normalized rate of penetration or the calculated, actual normalized mechanical specific energy for the section where the earth-boring tool 108 (see FIG. 1) is located to a benchmark normalized rate of penetration or a benchmark normalized mechanical specific energy stored in the memory device 170 (see FIG. 2). As a specific, nonlimiting example, the control unit 164 (see FIG. 2) may identify which section the earth-boring tool 108 (see FIG. 1) is located in by dividing the absolute, non-normalized depth of the earth-boring tool 108 (see FIG. 1) by the distance per section for the borehole 106 (see FIG. 1). The processing unit 168 of the control unit 164 (see FIG. 1), locally or at a remote server, The result of the comparison performed at act 228 may inform the resulting action taken. For example, when the calculated, actual normalized rate of penetration is greater than the benchmark normalized rate of penetration, or the calculated, actual normalized mechanical specific energy is less than the benchmark normalized mechanical specific energy, the comparison may indicate that the current earth-boring operation is outperforming each other earth-boring operation in the database. In such a situation, the control unit 164 (see FIG. 2), locally or utilizing the remote server, may automatically update the database and the benchmark wellbore, as shown at act 230, to reflect that the actual, normalized performance metric is the new benchmark performance metric for that section. For example, the performance metric, operating parameters, and operational state (normalized and absolute) for the corresponding section in the benchmark borehole may be replaced by the actual performance metric, operating parameters, and operational state (normalized and absolute) of the actual earth-boring operation performed by the earth-boring system 100 (see FIG. 1).

As another example, when the calculated, actual normalized rate of penetration is less than the benchmark normalized rate of penetration, or the calculated, actual normalized mechanical specific energy is greater than the benchmark normalized mechanical specific energy, the comparison may indicate that the current earth-boring operation is underperforming with respect to at least one other earth-boring operation in the database. In such a situation, the control unit 164 (see FIG. 2), locally or utilizing a remote server, may automatically change the operating parameters of the earth-boring system 100 (see FIG. 1) in some embodiments, as also shown at act 230 in FIG. 3. For example, the control unit 164 may at least periodically send a control signal to cause the drawworks 116, the rotational apparatus (e.g., the top drive 119), the pump 130 (see FIG. 1), or any combination of these to automatically change in real-time a weight applied to the length of drill pipe 114 and the earth-boring tool 108 (see FIG. 1), a number of surface rotations per minute, a rate of flow of drilling fluid 132 through the drill pipe 114 (see FIG. 1), or any combination of these to better match a corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or the benchmark normalized mechanical specific energy stored in the database. As other examples, the control unit 164 may at least periodically send control signals to cause the reamer(s) 122 to extend and/or retract one or more blades, the stabilizer(s) 126 to extend and/or retract one or more stabilizer arms, or a steering device to redirect a trajectory of the drill string 112 (see FIG. 1).

When it is said that the control signal may produce a "better match" between actual normalized operating parameters and the benchmark normalized operating parameters, what is meant is that the actual normalized operating parameters may be closer to the benchmark normalized operating parameters by a measurable amount as a result of a change to the operational state of the drill string 112 (see FIG. 1) or one or more components thereof. For example, the actual normalized operating parameter(s) may be at least substantially instantaneously changed to at least substantially equal the benchmark normalized operating parameter(s). As another example, the actual normalized operating parameter(s) may be gradually changed over a period of time (e.g., over a matter of seconds or minutes) until the actual normalized operating parameter(s) at least substantially equal the benchmark normalized operating parameter(s). As yet another example, the actual normalized operating parameter(s) may be changed in such a way that they at least substantially instantaneously, or over a period of time, reach values closer, but not equal to, the benchmark normalized operating parameter(s) (e.g., about 25%, 50%, or 75% closer to the benchmark normalized operating parameter(s) when compared to their starting values).

In some embodiments, regardless of whether the current earth-boring operation is outperforming or underperforming relative to the benchmark borehole, the control unit 164 may at least periodically, and optionally substantially continuously, cause the electronic display device 172 (see FIG. 2) to display the complex details of the real-time performance metric generation and normalization and tracking of the operational parameters, operational state, and environmental conditions versus the dynamic selection and updating of the benchmark borehole in a simplified manner, as also shown at act 230 in FIG. 3. For example, the control unit 164, locally or utilizing a remote server, may at least periodically send a control signal to the electronic display device(s) 172, causing the electronic display device(s) 172 (see FIG. 2) to display, in real time, the weight applied to the length of drill pipe 114 and the earth-boring tool 108 (see FIG. 1), the number of surface rotations per minute, the rate of flow of drilling fluid 132 through the drill pipe 114 (see FIG. 1), or any combination of these and a corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or the benchmark normalized mechanical specific energy. In some embodiments, the electronic display device(s) 172 (see FIG. 2) may also display, in real time, the at least periodically calculated, actual, normalized performance metric(s) and the corresponding, stored, normalized benchmark performance metric(s) for the section where the earth-boring tool 108 (see FIG. 1) is located, and optionally a historical.

Figure 6:
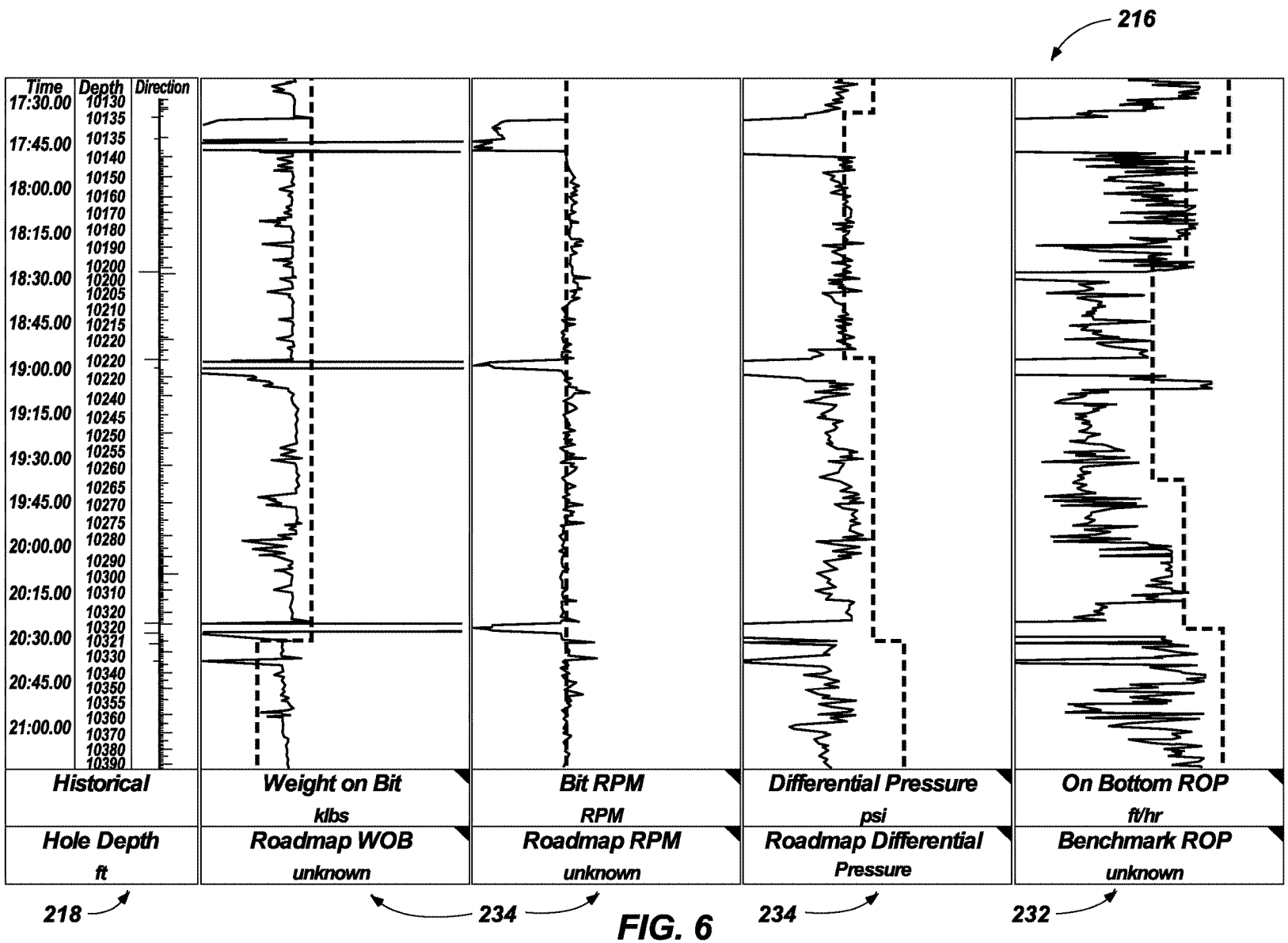
FIG. 6 is a still depiction of a frame in a graphical user interface outputtable by the control unit of FIG. 1.

FIG. 6 is a still depiction of a frame in a graphical user interface 216 outputtable by the control unit 164 of FIG. 1. The graphical user interface 216 may be generally in columnar format, with a first column 218 showing time and normalized depth, identifying the section where the earth-boring tool 108 (see FIG. 1) is currently located, as well as the historical progression of the earth-boring tool 108 through the sections of the borehole 106 (see FIG. 1) over time. More specifically, the first column 218 may include, for example, a periodically, or at least substantially continuously, updating, scrolling depiction (in text or images of numbers, as a series of points on a graph, and/or as a line on a chart) of time and distance, as associated with one another, which may be updated on a time basis (e.g., at least once per second, per minute, or per five minutes) or a normalized distance threshold basis (e.g., at least once every half-section or every section completed). Time and distance may be, for example, divided into their own separate, sub-columns within the first column 218. The first column 218 may also include a depiction of the direction in which the drill string 112 (see FIG. 1) is advancing. For example, the first column 218 may show (in text, images, and/or a line that extends to different sides of a threshold) whether the drill string 112 is advancing further into, retracting out from, or remaining at the same or at least substantially the same depth within the borehole 106 (see FIG. 1).

A second column 232 of the graphical user interface 216 may show the normalized benchmark performance metric, or a scaled version of the normalized benchmark performance metric to convert back to absolute units, for the section where the earth-boring tool 108 (see FIG. 1) is currently located, and optionally a historical record of the normalized benchmark performance metric, or the scaled version, in previously completed sections. To scale the normalized benchmark performance metric, the normalized benchmark performance metric may, for example, be multiplied by the distance per section for a actual borehole being formed or enlarged in the real-world earth-boring operation, completing a conversion from the actual performance metrics for the benchmark borehole, through the normalized performance metric, to a scaled version relative to the actual borehole 106. The second column 232 may also display, concurrently with the normalized benchmark performance metric, the actual normalized performance metric of the current earth-boring operation, or the actual, absolute performance metric, for the section where the earth-boring tool 108 (see FIG. 1) is located, and optionally a historical record of the actual normalized performance metric in previously completed sections. More specifically, the second column 232 may include, for example, a periodically, or at least substantially continuously, updating, scrolling depiction (in text or images of numbers, as a series of points on a graph, and/or as lines on a chart) of the normalized or scaled benchmark performance metric adjacent to the actual normalized or absolute performance metric, which may be updated concurrently with the first column 218. As a specific, nonlimiting example, the second column 232 may include an at least substantially continuously, updating, scrolling depiction as lines on a chart of the normalized or scaled benchmark performance metric (as a dashed line of a first color) on the same chart as the actual normalized or absolute performance metric (as a solid line of a second, different color), which may be updated concurrently with the first column 218, as well as a text field showing the real-time normalized values for the benchmark and actual performance metrics located underneath the chart.

The graphical user interface 216 may include one or more third columns 234, which may show one or more normalized or scaled operating parameters that achieved the benchmark performance metric for the section where the earth-boring tool 108 (see FIG. 1) is currently located, and optionally a historical record of the normalized or scaled operating parameters that achieved the benchmark performance metrics in previously completed sections. Scaling the operating parameters may be accomplished using the same techniques disclosed in connection with scaling the performance metrics. The third columns 234 may also display, concurrently with the normalized benchmark operating parameter(s), the actual normalized or absolute operating parameter(s) of the current earth-boring operation for the section where the earth-boring tool 108 (see FIG. 1) is located, and optionally a historical record of the actual normalized or absolute operating parameter(s) in previously completed sections. More specifically, each third column 234 may include, for example, a periodically, or at least substantially continuously, updating, scrolling depiction (in text or images of numbers, as a series of points on a graph, and/or as lines on a chart) of a respective normalized or scaled benchmark operating parameter adjacent to the corresponding actual normalized or absolute operating, which may be updated concurrently with the first column 218. As a specific, nonlimiting example, each third column 234 may include an at least substantially continuously, updating, scrolling depiction as lines on a chart of the respective normalized or scaled benchmark operational parameter (as a dashed line of a first color) on the same chart as the corresponding actual normalized or absolute operational parameter (as a solid line of a second, different color), which may be updated concurrently with the first column 218, as well as a text field showing the real-time normalized values for the benchmark and actual operating parameter located underneath the chart.

Figure 7:
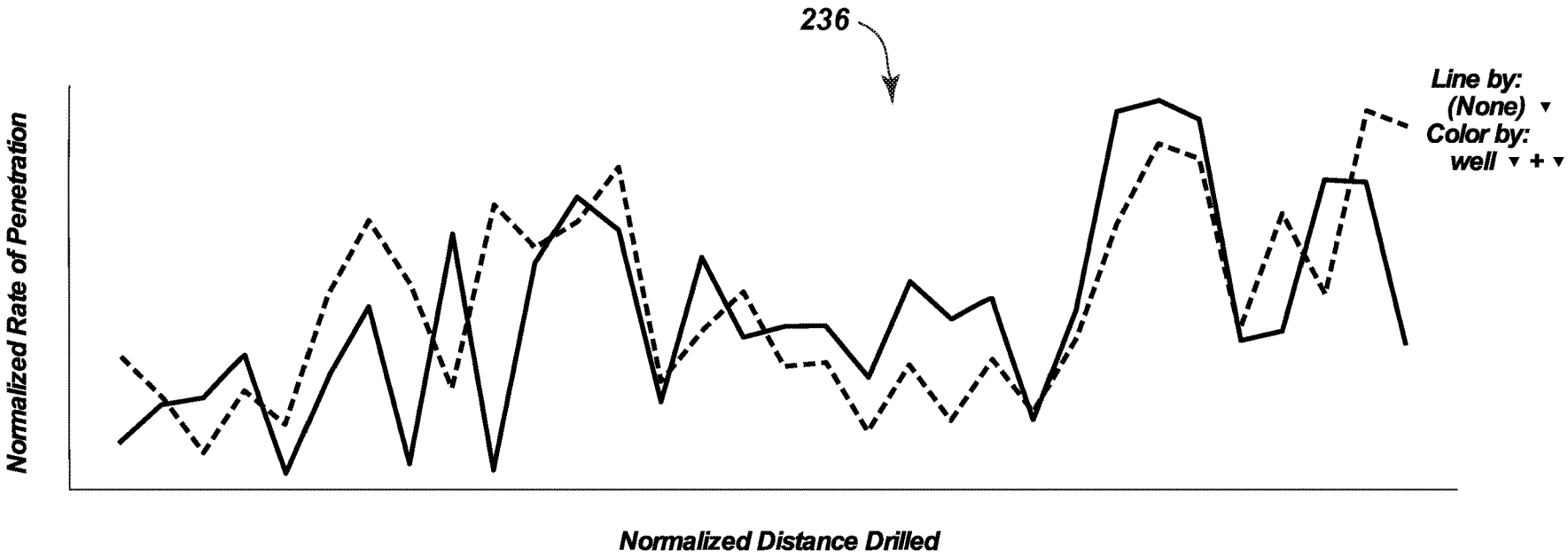
FIG. 7 is another still depiction of another frame in another graphical user interface outputtable by the control unit of FIG. 1.

FIG. 7 is another still depiction of another frame in another graphical user interface 236 outputtable by the control unit 164 of FIG. 1. The graphical user interface 216 may include a chart focusing on a single performance metric or operating parameter. For example, a user interested in a more detailed, focused view of the second column 232 or any one of the third columns 234 of FIG. 6 may select the respective column 232 or 234. More specifically, the graphical user interface 236 may include, for example, a periodically, or at least substantially continuously, updating, scrolling depiction (as a series of points on a graph and/or as lines on a chart) of a respective normalized benchmark operating parameter or performance metric plotted with the corresponding actual normalized operating parameter or performance metric, which may be updated in real time, as described previously in connection with FIG. 6. Specifically shown in FIG. 7 is a chart of the normalized rate of penetration, benchmark and actual, versus normalized distance (i.e., from section to section).

In other embodiments, graphical user interfaces depicting, in real time, absolute, normalized, or scaled performance metrics and/or operating parameters may operate and display as disclosed in U.S. Provisional Patent App. Ser. No. 62/620,918, filed Jan. 23, 2018, and titled "METHODS OF EVALUATING DRILLING PERFORMANCE AND METHODS OF IMPROVING DRILLING PERFORMANCE," the disclosure of which is incorporated in this application in its entirety by this reference. Briefly, the graphical user interfaces may utilize a plurality of different indicators, including text, graphics, color, or any combination or subcombination of these, to communicate to an operator with greater precision and accuracy what the real-time absolute, normalized, or scaled performance metrics and/or operating parameters are, what trends the absolute, normalized, or scaled performance metrics and/or operating parameters may be occurring over time, and what actions to improve absolute, normalized, or scaled performance metrics and/or operating parameters are recommended. As a specific, nonlimiting example, the graphical user interface may display in text and numbers what the real-time absolute, normalized, or scaled performance metrics and/or operating parameters are with associated units, in color what trends the absolute, normalized, or scaled performance metrics and/or operating parameters may be occurring over time (e.g., green for at or near optimal, yellow for trending away from optimal or approaching undesirable, or red for undesirable), and what actions to take, taken automatically by the system, or both to improve absolute, normalized, or scaled performance metrics and/or operating parameters are recommended (e.g., in text and numbers, using audio output, showing pictures of specific actions, or any combination or subcombination of these).

By normalizing real-time, sensed operating parameters and performance metrics, as well as dynamically selecting and normalizing benchmark operating parameters and performance metrics, systems and methods in accordance with this disclosure may more accurately set operating parameters for better automated earth-boring performance based on more comprehensive evaluation of earth-boring performance. In addition, the specific graphical user interface techniques, coupled with the normalization of real-time, sensed operating parameters and performance metrics, as well as dynamic selection and normalization of benchmark operating parameters and performance metrics, may simplify the display of complex performance metrics and recommended operating parameters to operators to enable better real-time manual control of earth-boring systems.

Additional, nonlimiting embodiments within the scope of this disclosure include the following:

Embodiment 1

A system for automatically and dynamically controlling a drill string for drilling an earth formation, comprising: a length of drill pipe; an earth-boring tool securable to, and rotatable with, the length of drill pipe; a drawworks configured to support the length of drill pipe and the earth-boring tool from the drawworks, the drawworks configured to raise and lower the length of drill pipe and to apply a weight on the earth-boring tool; a rotational apparatus configured to operatively connect to the length of drill pipe, the rotational apparatus configured to rotate the length of drill pipe and the earth-boring tool at a selectable number of surface rotations per minute; a pump configured to connect to the length of drill pipe, the pump configured to control a rate of flow of a drilling fluid through the drill pipe; and a control unit comprising a processing unit and a nontransitory memory device, the control unit operatively connectable to the drawworks, the rotational apparatus, and the pump to receive operational state data from the drawworks, the rotational apparatus, and the pump and to send control signals to the drawworks, the rotational apparatus, the pump, or any combination of these to automatically change the operational state of the drawworks, the rotational apparatus, the pump, or any combination of these, wherein the memory device of the control unit stores software that, when executed by the processing unit of the control unit, causes the control unit to: accept a planned trajectory for the length of drill pipe and the earth-boring tool into the earth formation, the planned trajectory including direction, distance, and earth formation type to be explored; divide the distance of the planned trajectory into a predetermined number of sections, normalizing the distance; at least periodically receive the operational state data from the drawworks, the rotational apparatus, and the pump; at least periodically calculate at least one of a normalized rate of penetration of the length of drill pipe and the earth-boring tool and a normalized mechanical specific energy of a earth-boring operation performed by the length of drill pipe and the earth-boring tool utilizing the operational state data from the drawworks and the normalized distance of the planned trajectory at least in part by dividing a raw rate of penetration or a raw mechanical specific energy by a distance per section; compare the calculated normalized rate of penetration or the calculated normalized mechanical specific energy to a benchmark normalized rate of penetration or a benchmark normalized mechanical specific energy stored in the memory device, the benchmark normalized rate of penetration or the benchmark normalized mechanical specific energy being a highest normalized rate of penetration or a lowest normalized mechanical specific energy in a database of normalized rates of penetration or normalized mechanical specific energies achieved in corresponding sections of other boreholes; and send a control signal to cause the drawworks, the rotational apparatus, the pump, or any combination of these to automatically change a weight applied to the length of drill pipe and the earth-boring tool, a number of surface rotations per minute, a rate of flow of drilling fluid through the drill pipe, or any combination of these to better match a corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or the benchmark normalized mechanical specific energy stored in the database.

Embodiment 2

The system of Embodiment 1, further comprising an electronic display device operatively coupled with the control unit and wherein the software stored by the memory device further causes the control unit to send a control signal to cause the electronic display device to display, in real time, the weight applied to the length of drill pipe and the earth-boring tool, the number of surface rotations per minute, the rate of flow of drilling fluid through the drill pipe, or any combination of these and the corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or a benchmark normalized mechanical specific energy when the software is executed by the processing unit of the control unit.

Embodiment 3

The system of Embodiment 1 or Embodiment 2, wherein the software stored by the memory device further causes the control unit to update the benchmark normalized rate of penetration or the benchmark normalized mechanical specific energy stored in the database, and the corresponding weight applied to the length of drill pipe and the earth-boring tool, the corresponding number of surface rotations per minute, the corresponding rate of flow of drilling fluid through the drill pipe, or any corresponding combination of these, with the normalized rate of penetration or the mechanical specific energy, and the weight applied to the length of drill pipe and the earth-boring tool, the number of surface rotations per minute, the rate of flow of drilling fluid through the drill pipe, or any combination of these, when the normalized rate of penetration is greater than the benchmark normalized rate of penetration or the normalized mechanical specific energy is less than the benchmark normalized mechanical specific energy.

Embodiment 4

The system of any one of Embodiments 1 through 3, further comprising: a rate of advancement sensor associated with the drawworks and operatively connected to the control unit, the rate of advancement sensor configured to send a signal indicative of the rate of penetration to the control unit; a rotational speed sensor associated with the rotational apparatus and operatively connected to the control unit, the rotational speed sensor configured to send a signal indicative of the number of surface rotations per minute to the control unit; and a flow rate sensor associated with the pump and operatively connected to the control unit, the flow rate sensor configured to send a signal indicative of the rate of flow of drilling fluid through the drill pipe to the control unit.

Embodiment 5

The system of any one of Embodiments 1 through 4, further comprising at least one of: a depth sensor associated with the earth-boring tool and operatively connected to the control unit, the depth sensor configured to send a signal indicative of a depth of the earth-boring tool in the borehole to the control unit; a hook load sensor associated with the drawworks and operatively connected to the control unit, the hook load sensor configured to send a signal indicative of the weight applied to the drill pipe and the earth-boring tool utilizing the drawworks to the control unit; a torque sensor associated with the drawworks and operatively connected to the control unit, the torque sensor configured to send a signal indicative of a torque applied to the drill pipe and the earth-boring tool utilizing the drawworks to the control unit; a pressure sensor associated with the pump and operatively connected to the control unit, the pressure sensor configured to send a signal indicative of a pressure of the drilling fluid proximate to the pump to the control unit; a differential pressure sensor associated with the drill string and operatively connected to the control unit, the differential pressure sensor configured to send a signal indicative of a differential pressure between the drilling fluid and formation fluids to the control unit; a gamma radiation sensor associated with the drill string and operatively connected to the control unit, the gamma radiation sensor configured to send a signal indicative of a quantity of gamma radiation emitted by a downhole earth formation to the control unit; an inclination sensor associated with the length of drill pipe and operatively connected to the control unit, the inclination sensor configured to send a signal indicative of an angle of inclination of the length of drill pipe relative to a vertical axis to the control unit; or an azimuth sensor associated with the length of drill pipe and operatively connected to the control unit, the azimuth sensor configured to send a signal indicative of a direction of the borehole relative to a reference direction on a horizontal plane to the control unit.

Embodiment 6

A method of automatically and dynamically controlling a drill string drilling an earth formation, comprising: lowering a length of drill pipe and an earth-boring tool connected thereto into a borehole, applying weight to the earth-boring tool via the length of drill pipe utilizing a drawworks, and rotating the length of drill pipe and the earth-boring tool utilizing a rotational apparatus; causing a drilling fluid to flow through the drill pipe utilizing a pump; dividing a distance of a planned trajectory stored in a nontransitory memory device of a control unit operatively connected to the drawworks, the rotational apparatus, and the pump into a predetermined number of sections, normalizing the distance, utilizing a processing unit of the control unit, the planned trajectory including a direction, the distance, and an earth formation type to be explored; at least periodically querying the drawworks, the rotational apparatus, and the pump utilizing the control unit and receiving operational state data from the drawworks, the rotational apparatus, and the pump at the control unit; at least periodically calculating at least one of a normalized rate of penetration of the length of drill pipe and the earth-boring tool and a normalized mechanical specific energy of an earth-boring operation performed by the length of drill pipe and the earth-boring tool utilizing the operational state data from the drawworks and the normalized distance of the planned trajectory at least in part by dividing a raw rate of penetration or a raw mechanical specific energy by a distance per section; at least periodically comparing the calculated normalized rate of penetration or the calculated normalized mechanical specific energy to a benchmark normalized rate of penetration or a benchmark normalized mechanical specific energy stored in the memory device, the benchmark normalized rate of penetration or the benchmark normalized mechanical specific energy being a highest normalized rate of penetration or a lowest normalized mechanical specific energy in a database of normalized rates of penetration or normalized mechanical specific energies achieved in corresponding sections of other boreholes; and at least periodically sending a control signal to cause the drawworks, the rotational apparatus, the pump, or any combination of these to automatically change in real-time a weight applied to the length of drill pipe and the earth-boring tool, a number of surface rotations per minute, a rate of flow of drilling fluid through the drill pipe, or any combination of these to better match a corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or the benchmark normalized mechanical specific energy stored in the database.

Embodiment 7

The method of Embodiment 6, further comprising at least periodically sending another control signal from the control unit to an electronic display device, causing the electronic display device to display, in real time, the weight applied to the length of drill pipe and the earth-boring tool, the number of surface rotations per minute, the rate of flow of drilling fluid through the drill pipe, or any combination of these and the corresponding weight applied to the length of drill pipe and the earth-boring tool, the corresponding number of surface rotations per minute, the corresponding rate of flow of drilling fluid through the drill pipe, or any corresponding combination of these that achieved the benchmark normalized rate of penetration or the benchmark normalized mechanical specific energy when the software is executed by the processing unit of the control unit.

Embodiment 8

The method of Embodiment 6 or Embodiment 7, further comprising sending another control signal from the control unit to an electronic display device, causing the electronic display device to display, in real time, the weight applied to the length of drill pipe and the earth-boring tool, the number of surface rotations per minute, the rate of flow of drilling fluid through the drill pipe, or any combination of these and the corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or a benchmark normalized mechanical specific energy when the software is executed by the processing unit of the control unit.

Embodiment 9

The method of any one of Embodiments 6 through 8, further comprising: filtering from the database those normalized rates of penetration or those normalized mechanical specific energies associated with earth formations different from an earth formation in which the earth-boring tool is located, leaving only those normalized rates of penetration or those normalized mechanical specific energies associated with earth formations the same as the earth formation in which the earth-boring tool is located in the filtered database; and selecting the benchmark normalized rate of penetration or the benchmark normalized mechanical specific energy from the database to be the highest normalized rate of penetration or the lowest normalized mechanical specific energy in the filtered database.

Embodiment 10

The method of any one of Embodiments 6 through 9, further comprising rendering the predetermined number of sections equal to an average distance of wellbores or relevant sections in feet divided by 20 and rounded to a nearest whole number before dividing the distance of the planned trajectory into the predetermined number of sections.

Embodiment 11

The method of any one of Embodiments 6 through 10, further comprising sending another control signal to cause the drawworks, the rotational apparatus, the pump, or any combination of these to automatically change the weight applied to the length of drill pipe and the earth-boring tool, the number of surface rotations per minute, the rate of flow of drilling fluid through the drill pipe, or any combination of these to better match another corresponding weight applied to the length of drill pipe and the earth-boring tool, another corresponding number of surface rotations per minute, another corresponding rate of flow of drilling fluid through the drill pipe, or any other corresponding combination of these that achieved the benchmark normalized rate of penetration or the benchmark normalized mechanical specific energy stored in the database in response to a change in earth formation material.

Embodiment 12

The method of any one of Embodiments 6 through 11, further comprising automatically replacing the benchmark normalized rate of penetration or the benchmark normalized mechanical specific energy with the calculated normalized rate of penetration or the calculated normalized mechanical specific energy when the calculated normalized rate of penetration is greater than the benchmark normalized rate of penetration or when the calculated normalized mechanical specific energy is less than the benchmark mechanical specific energy.

Embodiment 13

The method of any one of Embodiments 6 through 12, further comprising automatically updating each normalized rate of penetration or each normalized mechanical specific energy available for inclusion in the database before determining the highest normalized rate of penetration or the lowest normalized mechanical specific energy.

Embodiment 14

The method of any one of Embodiments 6 through 13, further comprising generating a earth-boring plan including at least a recommended weight to applied to the length of drill pipe and the earth-boring tool, a recommended number of surface rotations per minute, and a recommended rate of flow of drilling fluid through the drill pipe when following the planned trajectory by identifying the weight applied to the length of drill pipe and the earth-boring tool, the number of surface rotations per minute, and the rate of flow of drilling fluid through the drill pipe associated with the benchmark normalized rate of penetration or the benchmark normalized mechanical specific energy.

Embodiment 15

A method of calculating recommended drilling parameters and dynamically updating an electronic display device, comprising: lowering a length of drill pipe and an earth-boring tool connected thereto into a borehole, applying weight to the earth-boring tool via the length of drill pipe utilizing a drawworks, and rotating the length of drill pipe and the earth-boring tool utilizing a rotational apparatus; causing a drilling fluid to flow through the drill pipe utilizing a pump; dividing a distance of a planned trajectory stored in a nontransitory memory device of a control unit operatively connected to the drawworks, the rotational apparatus, and the pump into a predetermined number of sections, normalizing the distance, utilizing a processing unit of the control unit, the planned trajectory including a direction, the distance, and an earth formation type to be explored; at least periodically querying the drawworks, the rotational apparatus, and the pump utilizing the control unit and receiving operational state data from the drawworks, the rotational apparatus, and the pump at the control unit; at least periodically calculating at least one of a normalized rate of penetration of the length of drill pipe and the earth-boring tool and a normalized mechanical specific energy of a earth-boring operation performed by the length of drill pipe and the earth-boring tool utilizing the operational state data from the drawworks and the normalized distance of the planned trajectory at least in part by dividing a raw rate of penetration or a raw mechanical specific energy by a distance per section; at least periodically comparing the calculated normalized rate of penetration or the calculated normalized mechanical specific energy to a benchmark normalized rate of penetration or a benchmark normalized mechanical specific energy stored in the memory device, the benchmark normalized rate of penetration or the benchmark normalized mechanical specific energy being a highest normalized rate of penetration or a lowest normalized mechanical specific energy in a database of normalized rates of penetration or normalized mechanical specific energies achieved in corresponding sections of other boreholes; and at least periodically sending a control signal from the control unit to an electronic display device, causing the electronic display device to display, in real time, the weight applied to the length of drill pipe and the earth-boring tool, the number of surface rotations per minute, the rate of flow of drilling fluid through the drill pipe, or any combination of these and a corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or the benchmark normalized mechanical specific energy when the software is executed by the processing unit of the control unit.

Embodiment 16

The method of Embodiment 15, further comprising at least periodically sending another control signal to cause the drawworks, the rotational apparatus, the pump, or any combination of these to automatically change in real-time the weight applied to the length of drill pipe and the earth-boring tool, the number of surface rotations per minute, the rate of flow of drilling fluid through the drill pipe, or any combination of these to better match the corresponding weight applied to the length of drill pipe and the earth-boring tool, the corresponding number of surface rotations per minute, the corresponding rate of flow of drilling fluid through the drill pipe, or any corresponding combination of these that achieved the benchmark normalized rate of penetration or the benchmark normalized mechanical specific energy stored in the database.

Embodiment 17

The method of Embodiment 15 or Embodiment 16, further comprising sending another control signal from the control unit to the electronic display device, causing the electronic display device to display a historical record of the weight applied to the length of drill pipe and the earth-boring tool, the number of surface rotations per minute, the rate of flow of drilling fluid through the drill pipe, or any combination of these and the corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or a benchmark normalized mechanical specific energy when the software is executed by the processing unit of the control unit.

Embodiment 18

The method of Embodiment 17, wherein sending the control signal and the other control signal from the control unit to the electronic display device comprises causing the electronic display device to concurrently display the real-time and historical record of the weight applied to the length of drill pipe and the earth-boring tool, the number of surface rotations per minute, the rate of flow of drilling fluid through the drill pipe, or any combination of these.

Embodiment 19

The method of any one of Embodiments 15 through 18, further comprising sending another control signal from the control unit to the electronic display device, causing the electronic display device to concurrently display pre-planned values and real-time values for the weight applied to the length of drill pipe and the earth-boring tool, the number of surface rotations per minute, the rate of flow of drilling fluid through the drill pipe, or any combination of these.

Embodiment 20

The method of any one of Embodiments 15 through 19, further comprising sending a control signal to cause the drawworks, the rotational apparatus, the pump, or any combination of these to automatically change a weight applied to the length of drill pipe and the earth-boring tool, a number of surface rotations per minute, a rate of flow of drilling fluid through the drill pipe, or any combination of these to better match a corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or the benchmark normalized mechanical specific energy stored in the database.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure, as contemplated by the inventor.

What is claimed is:

1. A system for automatically and dynamically controlling a drill string for drilling an earth formation, comprising:

a length of drill pipe;

an earth-boring tool securable to, and rotatable with, the length of drill pipe;

a drawworks configured to support the length of drill pipe and the earth-boring tool from the drawworks, the drawworks configured to raise and lower the length of drill pipe and to apply a weight on the earth-boring tool;

a rotational apparatus configured to operatively connect to the length of drill pipe, the rotational apparatus configured to rotate the length of drill pipe and the earth-boring tool at a selectable number of surface rotations per minute;

a pump configured to connect to the length of drill pipe, the pump configured to control a rate of flow of a drilling fluid through the drill pipe; and a control unit comprising a processing unit and a non-transitory memory device, the control unit operatively connectable to the drawworks, the rotational apparatus, and the pump to receive operational state data from the drawworks, the rotational apparatus, and the pump and to send control signals to the drawworks, the rotational apparatus, the pump, or any combination of these to automatically change the operational state of the drawworks, the rotational apparatus, the pump, or any combination of these, wherein the memory device of the control unit stores software that, when executed by the processing unit of the control unit, causes the control unit to:

accept a planned trajectory for the length of drill pipe and the earth-boring tool into the earth formation, the planned trajectory including direction, distance, and earth formation type to be explored;

divide the distance of the planned trajectory into a predetermined number of sections, normalizing the distance;

at least periodically receive the operational state data from the drawworks, the rotational apparatus, and the pump;

at least periodically calculate at least one of a normalized rate of penetration of the length of drill pipe and the earth-boring tool and a normalized mechanical specific energy of a earth-boring operation performed by the length of drill pipe and the earth-boring tool utilizing the operational state data from the drawworks and the normalized distance of the planned trajectory at least in part by dividing a raw rate of penetration or a raw mechanical specific energy by a distance per section;

compare the calculated normalized rate of penetration or the calculated normalized mechanical specific energy to a benchmark normalized rate of penetration or a benchmark normalized mechanical specific energy stored in the memory device, the benchmark normalized rate of penetration or the benchmark normalized mechanical specific energy being a highest normalized rate of penetration or a lowest normalized mechanical specific energy in a database of normalized rates of penetration or normalized mechanical specific energies achieved in corresponding sections of other boreholes; and send a control signal to cause the drawworks, the rotational apparatus, the pump, or any combination of these to automatically change a weight applied to the length of drill pipe and the earth-boring tool, a number of surface rotations per minute, a rate of flow of drilling fluid through the drill pipe, or any combination of these to better match a corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or the benchmark normalized mechanical specific energy stored in the database.

2. The system of claim 1, further comprising an electronic display device operatively coupled with the control unit and wherein the software stored by the memory device further causes the control unit to send a control signal to cause the electronic display device to display, in real time, the weight applied to the length of drill pipe and the earth-boring tool, the number of surface rotations per minute, the rate of flow of drilling fluid through the drill pipe, or any combination of these and the corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or a benchmark normalized mechanical specific energy when the software is executed by the processing unit of the control unit.

3. The system of claim 1, wherein the software stored by the memory device further causes the control unit to update the benchmark normalized rate of penetration or the benchmark normalized mechanical specific energy stored in the database, and the corresponding weight applied to the length of drill pipe and the earth-boring tool, the corresponding number of surface rotations per minute, the corresponding rate of flow of drilling fluid through the drill pipe, or any corresponding combination of these, with the normalized rate of penetration or the mechanical specific energy, and the weight applied to the length of drill pipe and the earth-boring tool, the number of surface rotations per minute, the rate of flow of drilling fluid through the drill pipe, or any combination of these, when the normalized rate of penetration is greater than the benchmark normalized rate of penetration or the normalized mechanical specific energy is less than the benchmark normalized mechanical specific energy.

4. The system of claim 1, further comprising:

a rate of advancement sensor associated with the drawworks and operatively connected to the control unit, the rate of advancement sensor configured to send a signal indicative of the rate of penetration to the control unit;

a rotational speed sensor associated with the rotational apparatus and operatively connected to the control unit, the rotational speed sensor configured to send a signal indicative of the number of surface rotations per minute to the control unit; and a flow rate sensor associated with the pump and operatively connected to the control unit, the flow rate sensor configured to send a signal indicative of the rate of flow of drilling fluid through the drill pipe to the control unit.

5. The system of claim 1, further comprising at least one of:

a depth sensor associated with the earth-boring tool and operatively connected to the control unit, the depth sensor configured to send a signal indicative of a depth of the earth-boring tool in the borehole to the control unit;

a hook load sensor associated with the drawworks and operatively connected to the control unit, the hook load sensor configured to send a signal indicative of the weight applied to the drill pipe and the earth-boring tool utilizing the drawworks to the control unit;

a torque sensor associated with the drawworks and operatively connected to the control unit, the torque sensor configured to send a signal indicative of a torque applied to the drill pipe and the earth-boring tool utilizing the drawworks to the control unit;

a pressure sensor associated with the pump and operatively connected to the control unit, the pressure sensor configured to send a signal indicative of a pressure of the drilling fluid proximate to the pump to the control unit;

a differential pressure sensor associated with the drill string and operatively connected to the control unit, the differential pressure sensor configured to send a signal indicative of a differential pressure between the drilling fluid and formation fluids to the control unit;

a gamma radiation sensor associated with the drill string and operatively connected to the control unit, the gamma radiation sensor configured to send a signal indicative of a quantity of gamma radiation emitted by a downhole earth formation to the control unit;

an inclination sensor associated with the length of drill pipe and operatively connected to the control unit, the inclination sensor configured to send a signal indicative of an angle of inclination of the length of drill pipe relative to a vertical axis to the control unit; or an azimuth sensor associated with the length of drill pipe and operatively connected to the control unit, the azimuth sensor configured to send a signal indicative of a direction of the borehole relative to a reference direction on a horizontal plane to the control unit.

6. A method of automatically and dynamically controlling a drill string drilling an earth formation, comprising:

lowering a length of drill pipe and an earth-boring tool connected thereto into a borehole, applying weight to the earth-boring tool via the length of drill pipe utilizing a drawworks, and rotating the length of drill pipe and the earth-boring tool utilizing a rotational apparatus;

causing a drilling fluid to flow through the drill pipe utilizing a pump;

dividing a distance of a planned trajectory stored in a nontransitory memory device of a control unit operatively connected to the drawworks, the rotational apparatus, and the pump into a predetermined number of sections, normalizing the distance, utilizing a processing unit of the control unit, the planned trajectory including a direction, the distance, and an earth formation type to be explored;

at least periodically querying the drawworks, the rotational apparatus, and the pump utilizing the control unit and receiving operational state data from the drawworks, the rotational apparatus, and the pump at the control unit;

at least periodically calculating at least one of a normalized rate of penetration of the length of drill pipe and the earth-boring tool and a normalized mechanical specific energy of an earth-boring operation performed by the length of drill pipe and the earth-boring tool utilizing the operational state data from the drawworks and the normalized distance of the planned trajectory at least in part by dividing a raw rate of penetration or a raw mechanical specific energy by a distance per section;

at least periodically comparing the calculated normalized rate of penetration or the calculated normalized mechanical specific energy to a benchmark normalized rate of penetration or a benchmark normalized mechanical specific energy stored in the memory device, the benchmark normalized rate of penetration or the benchmark normalized mechanical specific energy being a highest normalized rate of penetration or a lowest normalized mechanical specific energy in a database of normalized rates of penetration or normalized mechanical specific energies achieved in corresponding sections of other boreholes; and at least periodically sending a control signal to cause the drawworks, the rotational apparatus, the pump, or any combination of these to automatically change in real-time a weight applied to the length of drill pipe and the earth-boring tool, a number of surface rotations per minute, a rate of flow of drilling fluid through the drill pipe, or any combination of these to better match a corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or the benchmark normalized mechanical specific energy stored in the database.

7. The method of claim 6, further comprising at least periodically sending another control signal from the control unit to an electronic display device, causing the electronic display device to display, in real time, the weight applied to the length of drill pipe and the earth-boring tool, the number of surface rotations per minute, the rate of flow of drilling fluid through the drill pipe, or any combination of these and the corresponding weight applied to the length of drill pipe and the earth-boring tool, the corresponding number of surface rotations per minute, the corresponding rate of flow of drilling fluid through the drill pipe, or any corresponding combination of these that achieved the benchmark normalized rate of penetration or the benchmark normalized mechanical specific energy when software is executed by the processing unit of the control unit.

8. The method of claim 6, further comprising sending another control signal from the control unit to an electronic display device, causing the electronic display device to display, in real time, the weight applied to the length of drill pipe and the earth-boring tool, the number of surface rotations per minute, the rate of flow of drilling fluid through the drill pipe, or any combination of these and the corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or a benchmark normalized mechanical specific energy when software is executed by the processing unit of the control unit.

9. The method of claim 6, further comprising:

filtering from the database those normalized rates of penetration or those normalized mechanical specific energies associated with earth formations different from an earth formation in which the earth-boring tool is located, leaving only those normalized rates of penetration or those normalized mechanical specific energies associated with earth formations the same as the earth formation in which the earth-boring tool is located in the filtered database; and selecting the benchmark normalized rate of penetration or the benchmark normalized mechanical specific energy from the database to be the highest normalized rate of penetration or the lowest normalized mechanical specific energy in the filtered database.

10. The method of claim 6, further comprising rendering the predetermined number of sections equal to an average distance of wellbores or relevant sections in feet divided by 20 and rounded to a nearest whole number before dividing the distance of the planned trajectory into the predetermined number of sections.

11. The method of claim 6, further comprising sending another control signal to cause the drawworks, the rotational apparatus, the pump, or any combination of these to automatically change the weight applied to the length of drill pipe and the earth-boring tool, the number of surface rotations per minute, the rate of flow of drilling fluid through the drill pipe, or any combination of these to better match another corresponding weight applied to the length of drill pipe and the earth-boring tool, another corresponding number of surface rotations per minute, another corresponding rate of flow of drilling fluid through the drill pipe, or any other corresponding combination of these that achieved the benchmark normalized rate of penetration or the benchmark normalized mechanical specific energy stored in the database in response to a change in earth formation material.

12. The method of claim 6, further comprising automatically replacing the benchmark normalized rate of penetration or the benchmark normalized mechanical specific energy with the calculated normalized rate of penetration or the calculated normalized mechanical specific energy when the calculated normalized rate of penetration is greater than the benchmark normalized rate of penetration or when the calculated normalized mechanical specific energy is less than the benchmark normalized mechanical specific energy.

13. The method of claim 6, further comprising automatically updating each normalized rate of penetration or each normalized mechanical specific energy available for inclusion in the database before determining the highest normalized rate of penetration or the lowest normalized mechanical specific energy.

14. The method of claim 6, further comprising generating a earth-boring plan including at least a recommended weight to applied to the length of drill pipe and the earth-boring tool, a recommended number of surface rotations per minute, and a recommended rate of flow of drilling fluid through the drill pipe when following the planned trajectory by identifying the weight applied to the length of drill pipe and the earth-boring tool, the number of surface rotations per minute, and the rate of flow of drilling fluid through the drill pipe associated with the benchmark normalized rate of penetration or the benchmark normalized mechanical specific energy.

15. A method of calculating recommended drilling parameters and dynamically updating an electronic display device, comprising:

lowering a length of drill pipe and an earth-boring tool connected thereto into a borehole, applying weight to the earth-boring tool via the length of drill pipe utilizing a drawworks, and rotating the length of drill pipe and the earth-boring tool utilizing a rotational apparatus;

causing a drilling fluid to flow through the drill pipe utilizing a pump;

dividing a distance of a planned trajectory stored in a nontransitory memory device of a control unit operatively connected to the drawworks, the rotational apparatus, and the pump into a predetermined number of sections, normalizing the distance, utilizing a processing unit of the control unit, the planned trajectory including a direction, the distance, and an earth formation type to be explored;

at least periodically querying the drawworks, the rotational apparatus, and the pump utilizing the control unit and receiving operational state data from the drawworks, the rotational apparatus, and the pump at the control unit;

at least periodically calculating at least one of a normalized rate of penetration of the length of drill pipe and the earth-boring tool and a normalized mechanical specific energy of a earth-boring operation performed by the length of drill pipe and the earth-boring tool utilizing the operational state data from the drawworks and the normalized distance of the planned trajectory at least in part by dividing a raw rate of penetration or a raw mechanical specific energy by a distance per section;

at least periodically comparing the calculated normalized rate of penetration or the calculated normalized mechanical specific energy to a benchmark normalized rate of penetration or a benchmark normalized mechanical specific energy stored in the memory device, the benchmark normalized rate of penetration or the benchmark normalized mechanical specific energy being a highest normalized rate of penetration or a lowest normalized mechanical specific energy in a database of normalized rates of penetration or normalized mechanical specific energies achieved in corresponding sections of other boreholes; and at least periodically sending a control signal from the control unit to an electronic display device, causing the electronic display device to display, in real time, the weight applied to the length of drill pipe and the earth-boring tool, a number of surface rotations per minute, a rate of flow of drilling fluid through the drill pipe, or any combination of these and a corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or the benchmark normalized mechanical specific energy when software is executed by the processing unit of the control unit.

16. The method of claim 15, further comprising at least periodically sending another control signal to cause the drawworks, the rotational apparatus, the pump, or any combination of these to automatically change in real-time the weight applied to the length of drill pipe and the earth-boring tool, the number of surface rotations per minute, the rate of flow of drilling fluid through the drill pipe, or any combination of these to better match the corresponding weight applied to the length of drill pipe and the earth-boring tool, the corresponding number of surface rotations per minute, the corresponding rate of flow of drilling fluid through the drill pipe, or any corresponding combination of these that achieved the benchmark normalized rate of penetration or the benchmark normalized mechanical specific energy stored in the database.

17. The method of claim 15, further comprising sending another control signal from the control unit to the electronic display device, causing the electronic display device to display a historical record of the weight applied to the length of drill pipe and the earth-boring tool, the number of surface rotations per minute, the rate of flow of drilling fluid through the drill pipe, or any combination of these and the corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or a benchmark normalized mechanical specific energy when the software is executed by the processing unit of the control unit.

18. The method of claim 17, wherein sending the control signal and the other control signal from the control unit to the electronic display device comprises causing the electronic display device to concurrently display the real-time and historical record of the weight applied to the length of drill pipe and the earth-boring tool, the number of surface rotations per minute, the rate of flow of drilling fluid through the drill pipe, or any combination of these.

19. The method of claim 15, further comprising sending another control signal from the control unit to the electronic display device, causing the electronic display device to concurrently display pre-planned values and real-time values for the weight applied to the length of drill pipe and the earth-boring tool, the number of surface rotations per minute, the rate of flow of drilling fluid through the drill pipe, or any combination of these.

20. The method of claim 15, further comprising sending a control signal to cause the drawworks, the rotational apparatus, the pump, or any combination of these to automatically change a weight applied to the length of drill pipe and the earth-boring tool, a number of surface rotations per minute, a rate of flow of drilling fluid through the drill pipe, or any combination of these to better match a corresponding weight applied to the length of drill pipe and the earth-boring tool, a corresponding number of surface rotations per minute, a corresponding rate of flow of drilling fluid through the drill pipe, or any corresponding combination of these that achieved the benchmark normalized rate of penetration or the benchmark normalized mechanical specific energy stored in the database.

* * * * *